US008006970B2

(12) United States Patent
Sauer

(10) Patent No.: US 8,006,970 B2
(45) Date of Patent: Aug. 30, 2011

(54) PROCESSING OF STACKS OF SHEETS OF SECURITIES INTO BUNDLES AND PACKS OF BUNDLES

(75) Inventor: Hartmut Karl Sauer, Himmelstadt (DE)

(73) Assignee: KBA-Giori S.A., Lausanne (CH)

( * ) Notice: Subject to any disclaimer, the term of this patent is extended or adjusted under 35 U.S.C. 154(b) by 254 days.

(21) Appl. No.: 12/309,120

(22) PCT Filed: Jul. 3, 2007

(86) PCT No.: PCT/IB2007/052580

§ 371 (c)(1),
(2), (4) Date: Jan. 7, 2009

(87) PCT Pub. No.: WO2008/010125

PCT Pub. Date: Jan. 24, 2008

(65) Prior Publication Data

US 2009/0243181 A1 Oct. 1, 2009

(30) Foreign Application Priority Data

Jul. 14, 2006 (EP) ..... 06117273

(51) Int. Cl.
*B65H 33/16* (2006.01)

(52) U.S. Cl. ..... 270/52.09; 270/52.17; 414/790.3; 414/789.2

(58) Field of Classification Search ..... 270/52.09, 270/52.17; 414/790.3, 789.2, 792.3, 792.4
See application file for complete search history.

(56) References Cited

U.S. PATENT DOCUMENTS 3,939,621 A 2/1976 Giori
3,982,453 A * 9/1976 D'Amato et al. ..... 83/23
4,045,944 A 9/1977 Giori
4,283,902 A * 8/1981 Giori ..... 53/399
4,453,707 A 6/1984 Kuhfuss
4,558,557 A 12/1985 Keuhfuss
5,012,932 A * 5/1991 Omura et al. ..... 209/534
(Continued)

FOREIGN PATENT DOCUMENTS

EP 0 598 679 B2 5/1994
EP 0 656 309 6/1995
EP 1 731 324 A1 12/2006
GB 2 262 729 A 6/1993
(Continued)

*Primary Examiner* — Patrick Mackey
(74) *Attorney, Agent, or Firm* — Clifford W. Browning; Krieg DeVault LLP

(57) ABSTRACT

There is described a method for processing stacks (1) of sheets of securities, especially banknotes, into bundles (3) and bundle packs (4), said sheets each having an array of security prints printed thereon which array comprises M columns and N rows. According to this method, each stack (1) of sheets is processed into M successive bundle groups (3*) of N individual bundles (3) each and these M successive bundle groups (3*) are stored in M separate storage areas (11), which storage areas (11) are vertically superposed, whereby each one of the M successive bundle groups (3*) is stored in a predetermined one of the M separate storage areas (11). Subsequent stacks (1) of sheets are processed, whereby each one of the M successive bundle groups (3*) processed from said subsequent stacks (1) of sheets is piled in the same predetermined one of said M separate storage areas (11) as the first stack (1) of sheets. When K stacks (1) of sheets have been processed, each storage area (11) contains a complete set (4*) of N bundle packs (4) of K bundles (3) each. There is also described a bundle collating system (10) for collecting the bundles (3) processed according to the above collating method.

31 Claims, 18 Drawing Sheets

U.S. PATENT DOCUMENTS

| | | | | |
|---|---|---|---|---|
| 5,405,240 | A * | 4/1995 | Uno | 414/794.2 |
| 5,626,005 | A * | 5/1997 | Klingelhoefer | 53/540 |
| 7,216,583 | B2 | 5/2007 | Schaede | |
| 2003/0131702 | A1 | 7/2003 | Sauer et al. | |
| 2004/0149541 | A1 | 8/2004 | Sauer | |
| 2006/0225586 | A1 | 10/2006 | Samanta | |
| 2007/0163209 | A1 | 7/2007 | Sauer et al. | |

FOREIGN PATENT DOCUMENTS

| | | |
|---|---|---|
| GB | 2 268 147 A | 1/1994 |
| WO | WO 01/49464 | 7/2001 |
| WO | WO 2004/016433 | 2/2004 |
| WO | WO 2005/018945 | 3/2005 |
| WO | WO 2005/085070 | 9/2005 |

* cited by examiner

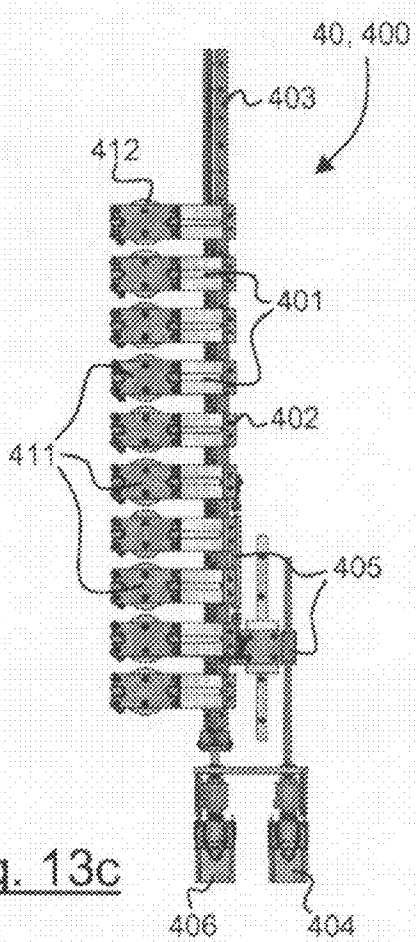
Fig. 13c
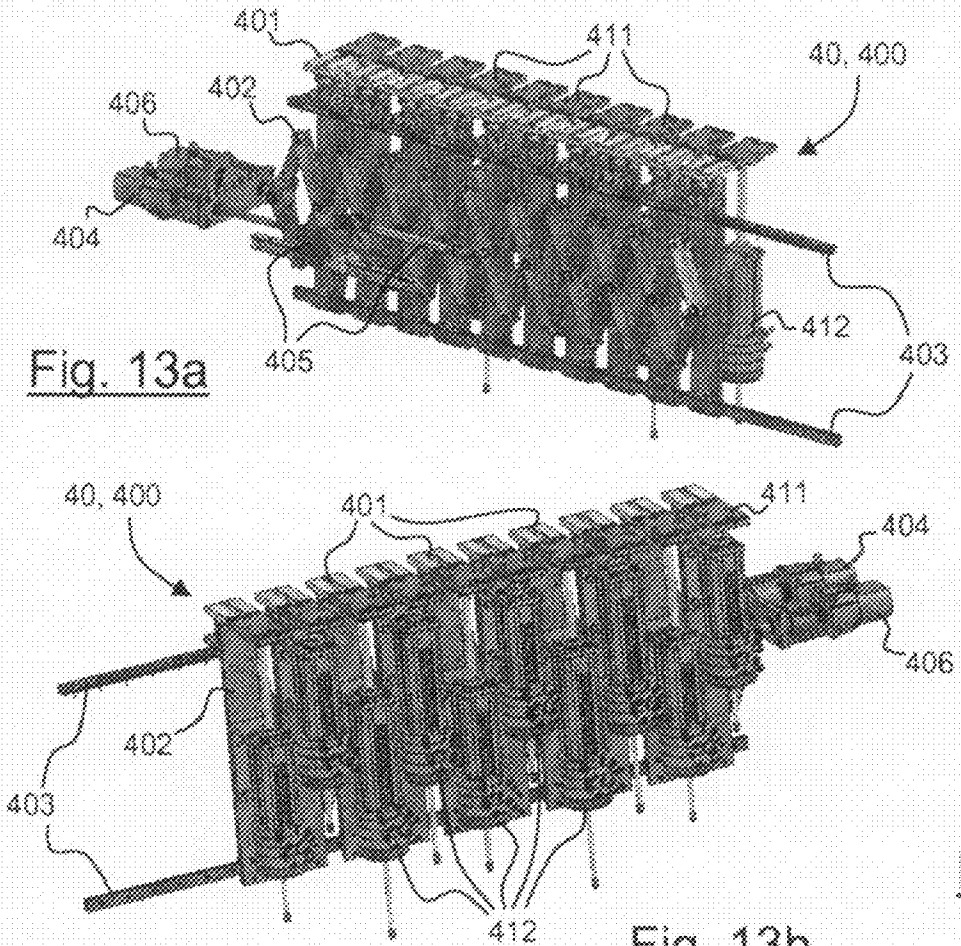
Fig. 13a
Fig. 13b

PROCESSING OF STACKS OF SHEETS OF SECURITIES INTO BUNDLES AND PACKS OF BUNDLES

This application claims the benefits under 35 U.S.C. 119 (a)-(d) or (b), or 365(b) of International Application No. PCT/IB2007/052580 filed Jul. 3, 2007, and European Patent Application No. 06117273.0 filed Jul. 14, 2006.

TECHNICAL FIELD

The present invention generally relates to the processing of stacks of sheets of securities, in particular banknotes, into bundles and packs of bundles.

BACKGROUND OF THE INVENTION

Methods and apparatuses for processing sheets of securities, especially banknotes, into bundles and packs are already known in the art.

As a matter of customary practice, the sheets are processed starting from stacks of hundred sheets, and these stacks are cut along rows and columns between the printed security papers to produce individual bundles of hundred security papers each. Prior to processing of the sheets, the security papers are numbered in such a manner that each bundle contains hundred security papers numbered in sequence. The bundles are banded and further processed to produce packs of, usually, ten bundles, i.e. packs comprising thousand security papers.

Numbering of the security papers is often carried out using mechanical numbering devices that are only adapted to perform incremental or decremental numbering (i.e. the number vary by one increment from one numbering iteration to the next). This implies that the numbering sequence is different for each bundle location in the stack of sheets and that the bundle with the numbering sequence that directly follows that of a given bundle will be derived from the same bundle location in the subsequent stack of sheets. Thus, in order to assemble packs of ten bundles each, one has to process ten successive stacks of sheets and collect all the bundles of a given bundle location within one and a same pocket or magazine. For sheets with M columns and N rows of security prints, one thus needs a so-called bundle collating system with M×N magazines having a storage capacity of ten bundles each.

Depending on the number of security papers on each sheet and on the sheet layout, bundle collating can be simplified to some extent. This is for instance possible when the number of security papers on each sheet is a multiple of ten as disclosed in European patent application No. EP 0 598 679. With this solution, a plurality of bundles with consecutive numbering sequence are located within a same stack of sheets, for instance in each column. Nevertheless, with this solution, one still derives several groups of bundles with different numbering sequences from each stack of sheets, and a collating system is therefore still required. In any case, this solution is not applicable to cases where sheets comprise a number of security prints that is not a multiple of ten.

Non-collating solutions which do not require a collating system are known in the art. With such non-collating solutions, numbering of the sheets has to be carried out in a specific manner that depends on the sheet layout, especially the number of security prints per sheet. This particular numbering principle is disclosed in International application No. WO 2004/016433. With such a numbering principle, all bundles derived from a given stack of sheets correspond to one consecutive numbering sequence, i.e. a stack of sheets with M×N security prints yields M×N bundles numbered in sequence, that is M×N×100 security papers numbered in sequence. The above numbering scheme enabling non-collating processing of stacks of sheets requires specific numbering devices which are usually more expensive than mechanical numbering devices.

Depending on the number of security papers on each sheet and on the sheet layout, mechanical numbering devices can be envisaged to carry out numbering according to the numbering scheme of WO 2004/016433. This is again possible when the number of security papers on each sheet is a multiple of ten (or of twenty-five). One such solution is disclosed in International application No. WO 2005/018945. Another alternate solution is disclosed in European patent application No. EP 1 731 324 in the name of the present Applicant. As before, such solutions are not applicable to cases where sheets comprise a number of security prints that is not a multiple of ten or of twenty-five.

Bundle collating systems are therefore required. Various solutions are known in the art.

U.S. Pat. No. 3,939,621 discloses an apparatus for processing sheets of security prints into bundles and packs comprising a rotary-drum bundle collating system. This bundle collating system comprises two rotating drums each provided with as many magazines as there are security prints on the sheets (i.e. M×N magazines). One drum at a time collects bundles to form packs of bundles in the magazines. When in operation, the drum is rotated with a mean circumferential speed matching that of the conveying means bringing the bundles, so that each bundle of a same stack of sheets is fed successively to a different one of the drum magazines. Once the magazines are filled up with the required number of bundles (i.e. following the processing of ten successive stacks of sheets), the following bundles are fed to the other drum. While the other drum is in operation, the magazines of the first drum are emptied one after the other and the packs are fed to a packaging station. Similar rotary-drum collating systems are further described in U.S. Pat. Nos. 4,045,944, 4,453,707, 4,558,557, and European patent application No. EP 1 607 355.

Another solution is disclosed in European patent application No. EP 0 656 309. This document discloses an apparatus for processing sheets of security prints into bundles and packs comprising a distributor with a rectilinear conveying stage on which all the bundles of a given stack of sheets are transported one behind the other up to predetermined positions above M×N magazines. The conveying stage is provided with a movable bottom which is designed to be opened once the bundles have been appropriately positioned above the magazines to thereby enable the bundles to fall in the magazines. The movable bottom is then closed and a subsequent series of bundles is fed onto the conveying stage, the process being repeated until the magazine are completely filled with bundles. Once the magazines are full, these are emptied by pushing the thus formed packs to the side out of the magazines onto a transport stage running next to the magazines. Other similar distributors with rectilinear conveying stage are also known from British patent application No. GB 2 262 729 and International application No. WO 01/49464.

A problem with the above bundle collating systems resides in the fact that they are dependent on the number of security prints on the sheets and on the sheet layout. Indeed, if the sheets to be processed are changed to sheets with a different number of security prints, the number of magazines has to be changed and the size thereof must be adapted as the size of the bundles changes as well.

In addition, the known collating systems occupy a substantial footprint which gives rise to difficulties when the available space for installation of the finishing equipment is limited.

There is therefore a need for an improved bundle collating system and method.

SUMMARY OF THE INVENTION

An aim of the present invention is thus to provide an improved method and system for processing stacks of sheets of securities into bundles and packs.

More precisely, an aim of the present invention is to provide such a method and system which enable collating of bundles in a more efficient manner and which can be implemented for varying sheet layouts without this requiring major changes to the way the bundles are collated.

Another aim of the invention is to provide such a method and system which can easily be adapted and adjusted to the sheet layouts, and especially to the number of prints per sheet and the size thereof.

Still another aim of the invention is to provide such a method and system which enables reduction of the footprint of the bundle collating system and therefore footprint of the sheet processing system as a whole.

These aims are achieved thanks to the method defined in claim 1 and the bundle collating system defined in claim 12. Also claimed is a sheet processing system for carrying out the method and which comprises the bundle collating system.

Advantages embodiments of the invention form the subject-matter of the dependent claims.

BRIEF DESCRIPTION OF THE DRAWINGS

The features and advantages of the present invention will appear more clearly from reading the following detailed description of embodiments of the invention which are presented solely by way of non-restrictive examples and illustrated by the attached drawings in which:

FIGS. 13*a* to 13*c* are perspective views of a same format-adjustable bundle rotating mechanism for selectively rotating bundles by 180 shown in three different configurations;

EMBODIMENTS OF THE INVENTION

Figure 1:
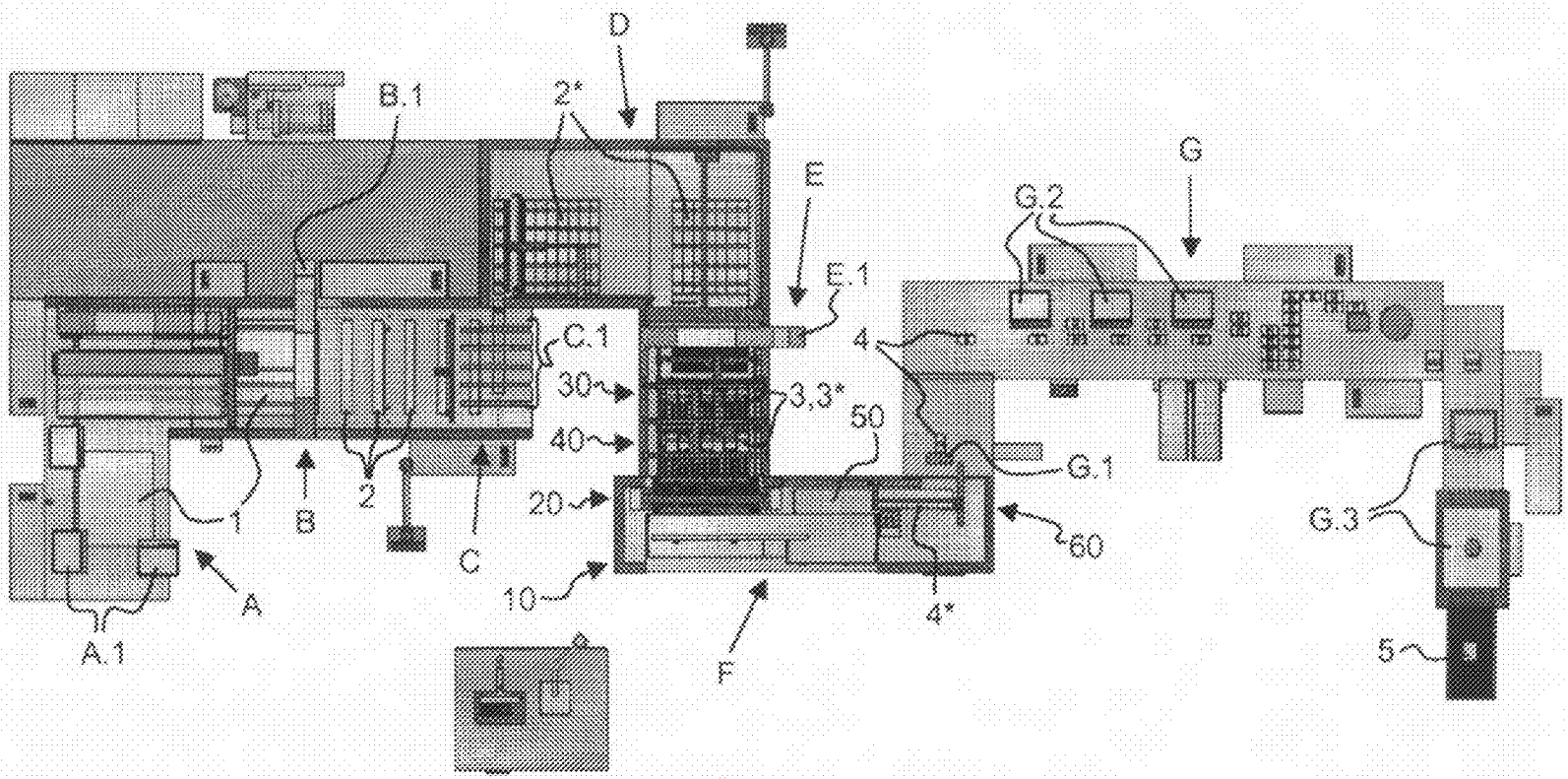
FIG. 1 is a top view of a sheet processing system for processing stacks of sheets of securities, especially banknotes, into bundles and packs of bundles according to a preferred embodiment of the invention.
Figure 2:
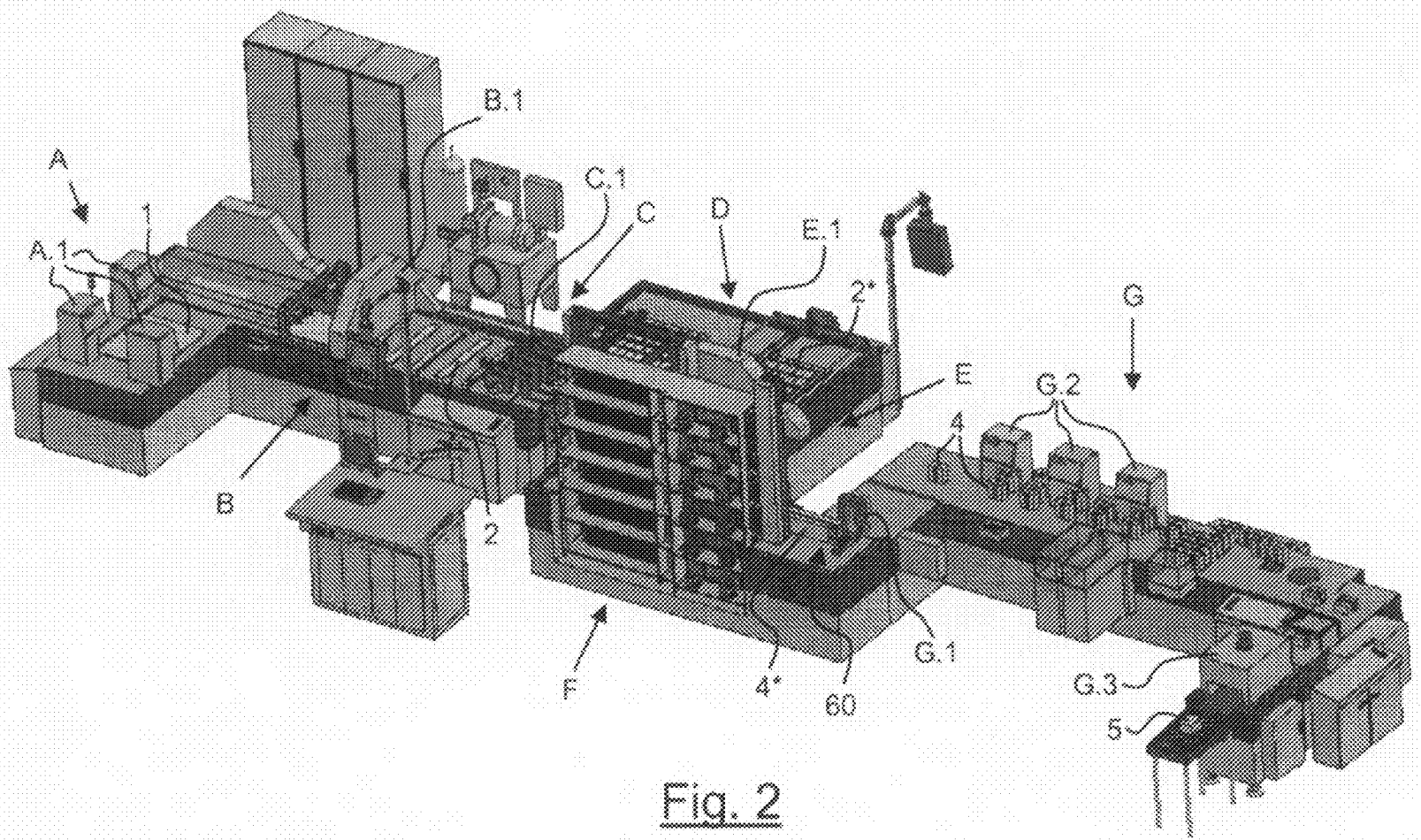
FIG. 2 is a perspective view of the embodiment of FIG. 1.

FIG. 1 is a top view of a sheet processing system for processing stacks of sheets of securities, especially banknotes, into bundles and packs of bundles (or "bundle packs") according to a preferred embodiment of the invention. FIG. 2 shows the same sheet processing system in perspective view. As already mentioned in the preamble, it will be understood that each sheet carries an array of security prints printed thereon, which array comprises M columns and N rows. The actual number of columns and rows of security prints on the sheets understandably depends on the sheet dimensions and on the dimensions of each security print.

Figure 3:
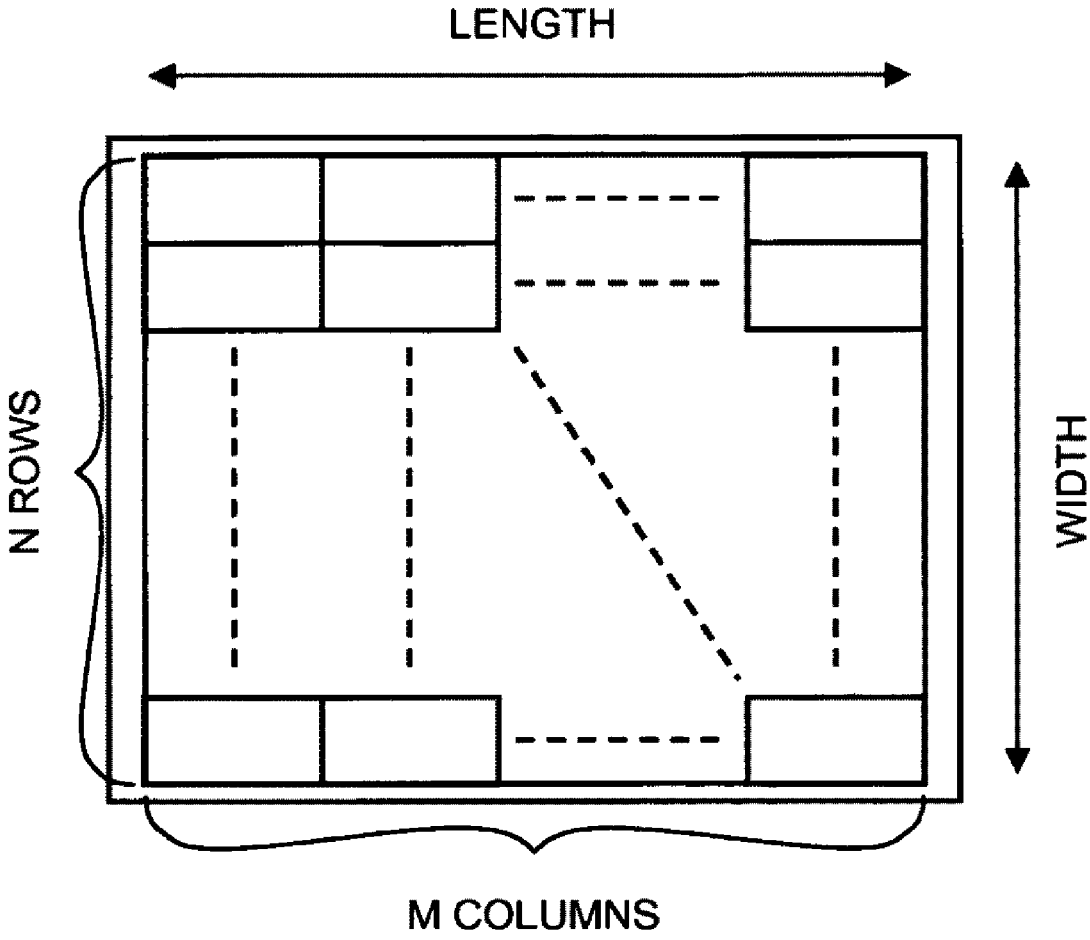
FIG. 3 is a schematic view of a sheet layout illustrating the notions of <<columns>>, <<rows>>, <<length>> and <<width>> within the scope of the present invention.

Within the scope of the present invention, and for the sake of clarity, the term "columns" should be understood as referring to the parallel arrangement of security prints one next to the other along the length of the sheets, while the term "rows" should be understood as referring to the parallel arrangement of security prints one next to the other along the width of the sheets. Strictly speaking, the terms "columns" and "rows" are however interchangeable. FIG. 3 schematically illustrates these notions.

As is typical in the art, the sheet dimensions may for instance be as much as 820 mm in length per 700 mm in width (i.e. 820×700 mm). With such sheet dimensions, six (M=6) columns per ten (N=10) rows of security prints with dimensions of 130×65 mm might for instance be provided on the sheets. With sheet dimensions of 740×680 mm, four (M=4) columns per seven (N=7) rows of security prints with dimensions of 180×90 mm might for instance be provided on the sheets. For small sheet dimensions, e.g. of 420×400 mm, four (M=4) columns per six (N=6) rows of security prints with dimensions of 100×60 mm might for instance be provided on the sheets. The above examples are of course given for the purpose of illustration only.

It will be appreciated that the bundle collating system described in connection with the preferred embodiment of the invention is designed to process sheets having dimensions as high as 820×700 mm, with a maximum security print size of 180×90 mm, a maximum number of columns of security prints of six ($M_{MAX}$=6) and a maximum number of rows of security prints of ten ($N_{MAX}$=10). Further, as is usual in the art, the sheets are processed in stacks of hundred sheets each, yielding individual bundles of hundred securities, which bundles are then assembled in packs of ten (K=10) bundles, i.e. a thousand securities (so-called "thousands packs"). The typical height of a bundle of hundred securities is of the order of 15 mm, yielding therefore a height for a thousands pack of the order of 150 mm. The above numerical examples are again not to be considered as limiting. The bundle collating system may easily be adapted in order to process sheets and/or securities of greater dimensions, a greater number of columns and/or rows of security prints, and/or a greater bundle and/or pack height without departing from the scope of the invention.

As illustrated in FIGS. 1 and 2, the sheet processing system comprises a feeding station A where stacks 1 of sheets to be processed are disposed, a first cutting station B where each stack 1 of sheets is cut along the rows of security prints into successive bundle strips 2, a banding station C where each bundle strip 2 is provided with surrounding bands distributed around the various bundle positions (ultimately forming bands around the individual bundles), a collecting station D where the bundle strips 2 are regrouped into a stack-like formation, designated by reference 2*, corresponding to the original formation of the stack of sheets 1, a second cutting station E where the regrouped bundle strips 2, 2* are cut along the columns of security prints so as to form individual bundles 3, a bundle collating station F where the individual bundles are collated in the appropriate sequence to form packs 4 of K bundles each, and a final processing station G where the bundle packs 4 are further processed (e.g. provision of surrounding bands around the thousands packs, counting of the securities for verification purposes, shrink-wrapping of the packs, further packing onto pallets, etc.).

The arrangement and operation of stations A to E is as such known in the art, especially from U.S. Pat. No. 4,283,902 (see also U.S. Pat. Nos. 4,453,707, 4,558,557).

At feeding station A, the supplied stacks 1 of sheets are typically counted by means of counting devices A.1 and aligned before being transported to the first cutting station B. Optionally, additional cutting stations might be provided to cut the margins of the sheets as is known in the art.

First cutting station B is typically provided with a known cutting device B.1 to cut each stack 1 of sheets along the rows of security prints, i.e. parallel to the length of the sheets, thereby producing a plurality of successive bundle strips 2 corresponding in number to the number of rows of security prints on the processed sheets. In the illustrated example, and for the purpose of explanation only, each sheet carries thirty-five security prints arranged in five (M=5) columns and seven (N=7) rows, the size of the sheets being of the order of the above-mentioned maximum sheet size of 820×700 mm. This means that each stack 1 of sheets is cut into seven successive bundle strips 2 at the first cutting station B, each bundle strip 2 encompassing five bundles 3 still connected to each other and that will ultimately be separated at the second cutting station E.

Banding station C is provided with a plurality of known banding devices C.1 which are distributed perpendicularly to the length of the bundle strips 2 to provide a plurality of surrounding bands at the various bundle positions of each bundle strip 2. Such banding devices C.1 are for instance known from International application No. WO 2005/085070 in the name of the present Applicant. In the illustrated example, five such banding devices C.1 are distributed along the length of the bundle strips 2 so as to provide five surrounding bands around the bundle strips 2 at each one of the five bundle positions.

Collecting station D acts as a sort of buffer enabling all the bundle strips 2 of one and a same stack 1 of sheets to be regrouped prior to being fed to the second cutting station E. Means known in the art are thus provided to transport each bundle strip 2 coming from the output of the banding station C to a regrouping area and, once the stack-like formation 2* corresponding to the original stack 1 of sheets has been reconstituted, to transport the whole group of bundle strips 2 to a feeding area in front of the second cutting station E.

Second cutting station E is similar to first cutting station B and is likewise provided with a cutting device E.1. This cutting device E.1 is however oriented in such a manner that the cutting operation is performed along the columns of security prints, i.e. parallel to the width of the sheets. In the illustrated example, seven individual bundles 3 are thus produced after each cutting operation at the second cutting station E. At the output of the second cutting station E, five successive groups of seven bundles 3 each (hereinafter referred to as "bundle groups" and designated by reference numeral 3*) are thus produced and are fed to the subsequent bundle collating station F.

The bundle collating station F is equipped with a bundle collating system, designated globally by reference numeral 10, that will be described hereinafter in greater detail. The purpose thereof is to process the successive bundle groups 3* coming out of the second cutting station E so as to collect and assemble the bundles 3 in the appropriate sequence and form the bundle packs 4. In the context of the present invention, it will be appreciated that the sheets are numbered in such a way that an uninterrupted numbering sequence is present in the superposition of bundles 3 coming from the same locations in successive stacks of sheets. In other words, all the bundles 3 derived from one stack 1 of sheets belong to distinct numbering sequences which have to be processed in as many bundle packs 4. In the illustrated example with thirty-five security prints per sheet, this means that the bundle collating system will process the bundles 3 in series of thirty-five distinct bundle packs 4.

Once collated in the appropriate sequence, the various bundle packs 4 are transferred to the final processing station G which may for instance comprise, as is usual in the art, a banding device G.1 for providing a surrounding band around each bundle pack 4, a plurality of counting devices G.2 for checking that the appropriate number of securities is present in each pack 4 (namely a thousand securities) and a shrink-wrapping device G.3 for wrapping the bundle packs 4 in a plastic packing (reference 5 in FIGS. 1 and 2 designates a shrink-wrapped pack 4). Additional devices might be provided in this final processing station G, such as further packing stations for assembling a plurality of thousands packs 4 into packs of several thousands of securities and/or a conditioning device (e.g. a robot) for piling the shrink-wrapped packs 5 onto a pallet.

Figure 4:
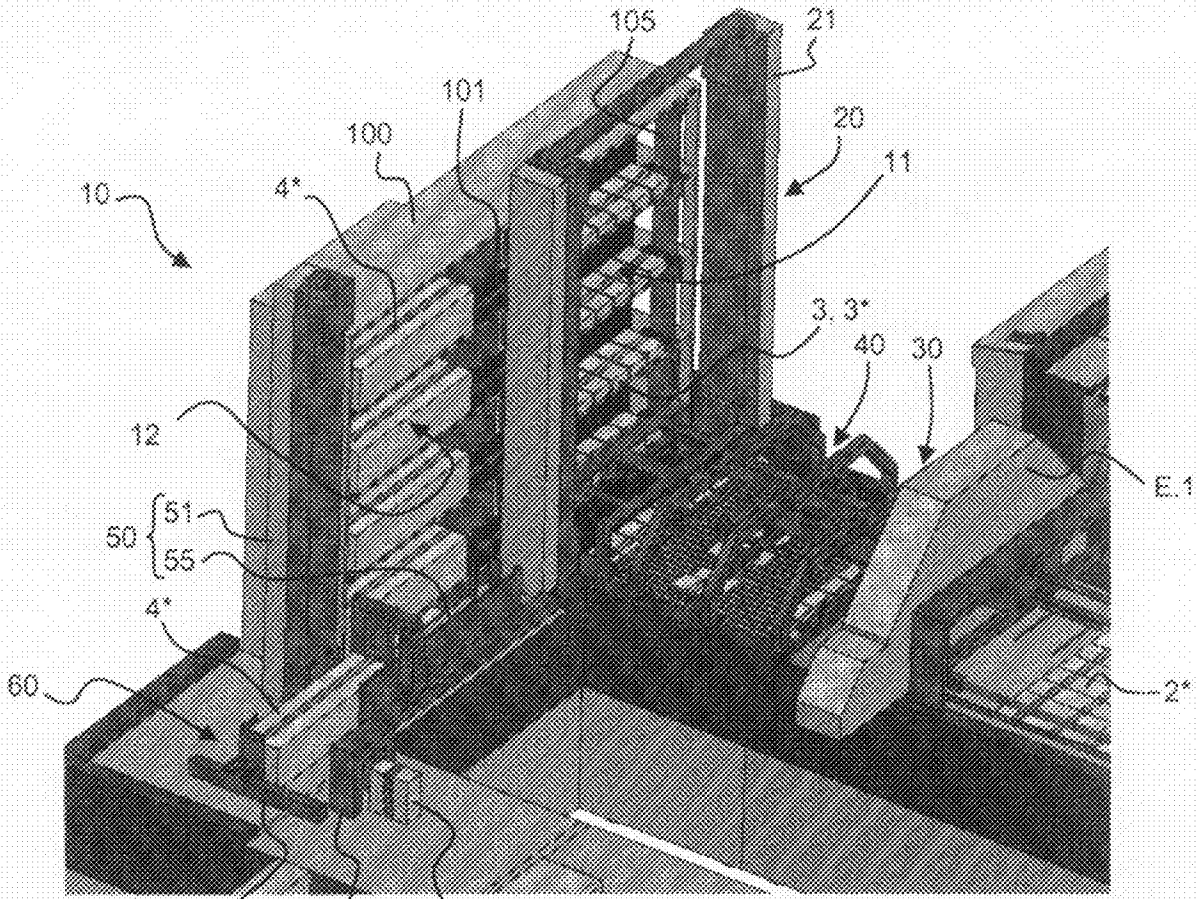
FIG. 4 is an enlarged perspective view of the bundle collating station of the embodiment of FIGS. 1 and 2.
Figure 5:
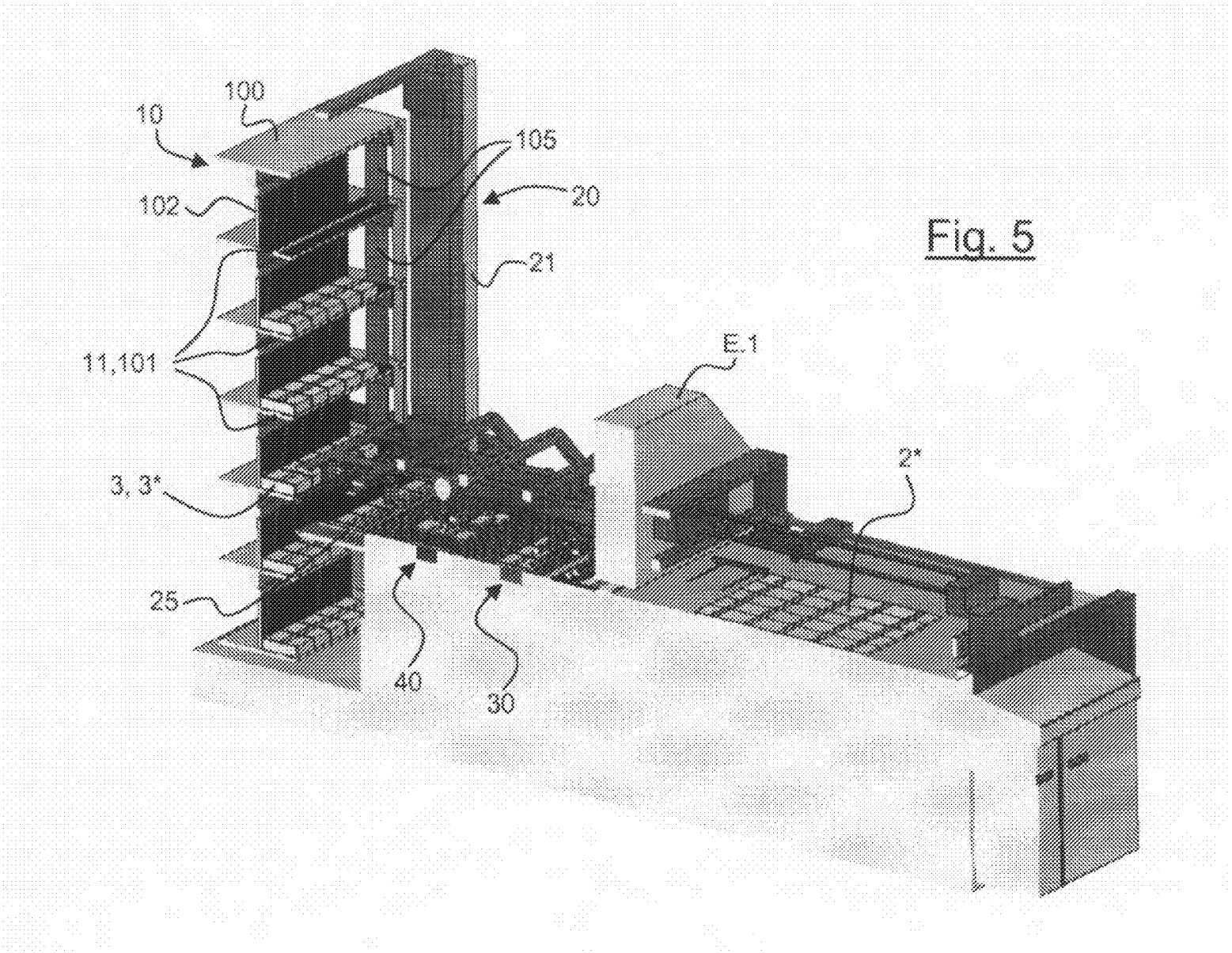
FIGS. 5 and 6 are enlarged perspective cross-section views illustrating more precisely the structure and arrangement of the bundle collating system used in the bundle collating station of FIG. 4.
Figure 6:
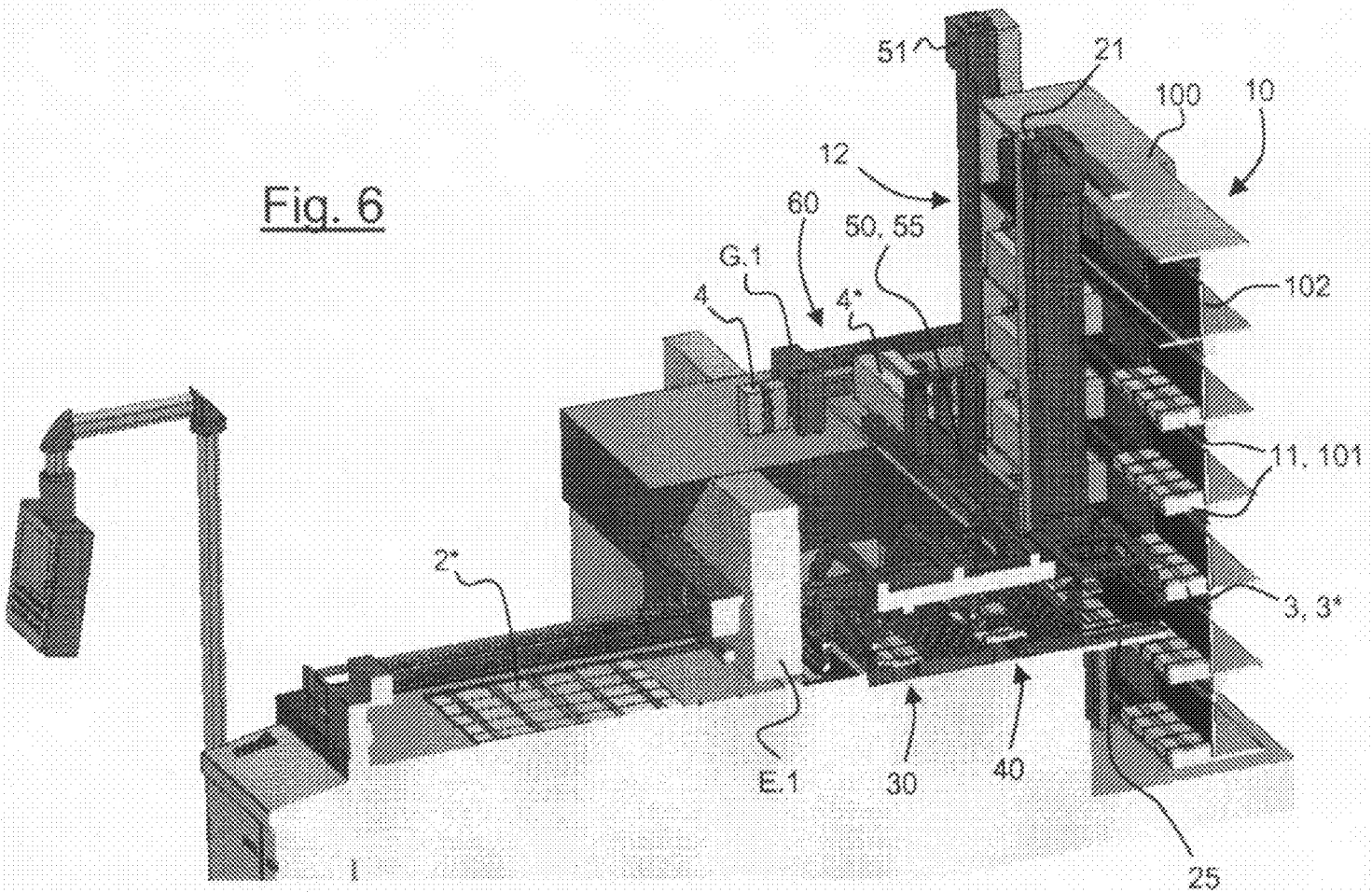

FIG. 4 is an enlarged perspective view of the bundle collating system 10 showing the path of the bundles 3 from the output of the cutting device E.1 of the second cutting station E to the banding device G.1 of the final processing station G. FIGS. 5 and 6 are enlarged perspective cross-section views illustrating more precisely the structure and arrangement of the bundle collating system 10.

As illustrated in FIGS. 4, 5 and 6, the bundle collating system 10 comprises a plurality of separate storage areas 11 for receiving the successive bundle groups 3* coming out of the second cutting station E. In the preferred embodiment, these storage areas 11 are vertically superposed and are designed as superposed storage shelves 101 of a vertical storage device 100. This vertical arrangement of the storage areas 11 is particularly advantageous in that it permits to minimize the system's footprint, in particular as compared to the known bundle collating systems of the prior art. More precisely, in the preferred embodiment, the vertical storage device 100 comprises six storage shelves 101 defining as many storage areas 11 for assembling the bundles 3 into packs 4. The number of storage areas 11 is selected to correspond to the maximum number of columns of security prints per sheet mentioned hereinabove. Each bundle group 3* coming in succession from the second cutting station E will be led to a different one of the storage areas 11, i.e. the bundle groups 3* corresponding to the first to $M^{th}$ columns of security prints on the sheets will be respectively stored in first to $M^{th}$ storage areas out of the available storage areas 11. One will thus understand that, depending on the sheet layout, part or all of the storage areas 11 will be used. In the illustrated example of FIGS. 5 and 6, as the sheets comprise only five columns of security prints each, only five out of the six storage areas 11 are used, e.g. the first five storage shelves 101 starting from the lowermost storage shelf, the uppermost storage shelf 101 being left empty. In FIG. 4, bundles are shown on the uppermost storage shelf 101 for the purpose of illustration only.

The storage capacity of each storage area 11 is selected so as to be sufficient for storing and piling the successive bundle groups 3* coming out of the second cutting station E into the desired bundle packs 4. More precisely, the width of each storage area 11 should be sufficient to receive the bundle groups 3* derived for each column of security prints (and will therefore be determined by the maximum width of the sheets to be processed), while the depth of each storage area 11 should be sufficient to receive bundles of the maximum length (which depth is thus determined by the maximum length of the securities to be derived from the sheets). The height of each storage area 11, on the other hand, should be sufficient to receive the desired number (K) of bundles 3 per pack 4, usually ten (which height is thus determined by the thickness of the securities and the resulting height of the bundles and bundle packs). In that respect, it will be appreciated that FIGS. 4, 5 and 6 show partly complete bundle packs 4 in the storage areas 11.

Preferably, as this will be described hereinafter, the depth of each storage area 11 is made adjustable through the provision of a movable rear wall 102 that is adjusted as a function of the format of the securities to be processed from the sheets (i.e. as a function of the length of the securities).

The various bundle groups 3* coming column after column out of the second cutting station E are transported to the desired storage area 11 by means of a loading lift system 20 with a movable carrier 25 which will be described in greater detail hereinafter. Prior to being fed to the loading lift system 20, the successive bundle groups 3* coming out of the cutting device E.1 are preferably fed in succession to a bundle spacing station 30 where the bundles 3 of each bundle group 3* are spaced apart so as to create clearings between the bundles 3, and a bundle rotating station 40 where half of the bundles 3 are rotated by 180° (both stations 30 and 40 will be described hereinafter). Optionally, means might be provided between the bundle rotating station 40 and the loading lift system 20 in order to push back the bundles 3 against each other after rotation, this enabling reduction of the storage width required to store the bundles 3 in the storage areas 11. In an alternate embodiment, the functions of both stations 30 and 40 could be fulfilled by one and a single station.

Still according to the preferred embodiment, once packs 4 of ten (K=10) bundles 3 have been assembled in a storage area 11, all these packs 4 are unloaded to a temporary unloading area 12. In the illustrated embodiment, six such temporary unloading areas 12 are provided next to the storage areas 11. Advantageously, each storage shelf 101 extends transversely to the loading direction of the bundle groups 3* and a pusher device 105 is provided on the side of each storage area 11 in order to push the assembled bundle packs 4 from the storage areas 11 to the temporary unloading areas 12. In the Figures, complete sets of N assembled bundle packs 4 which are transferred to the temporary unloading areas 12 are designated by reference 4*.

Once unloaded in the temporary unloading areas 12, the complete sets 4* of assembled bundle packs 4 are unloaded one by one to be fed to the final processing station G. This is performed thanks to an unloading lift system 50 with a movable carrier 55 which can be brought next to any selected one of the temporary unloading areas 12 and by simultaneously pushing a complete set 4* of assembled bundle packs 4 out of the selected temporary unloading area 12 onto the movable carrier 55. The movable carrier 55 is then moved in front of an output station 60 where the movable carrier 55 is emptied. These packs 4 are then isolated one by one at the output station 60 to be fed to the banding device G.1 of the final processing station G.

Figure 7:
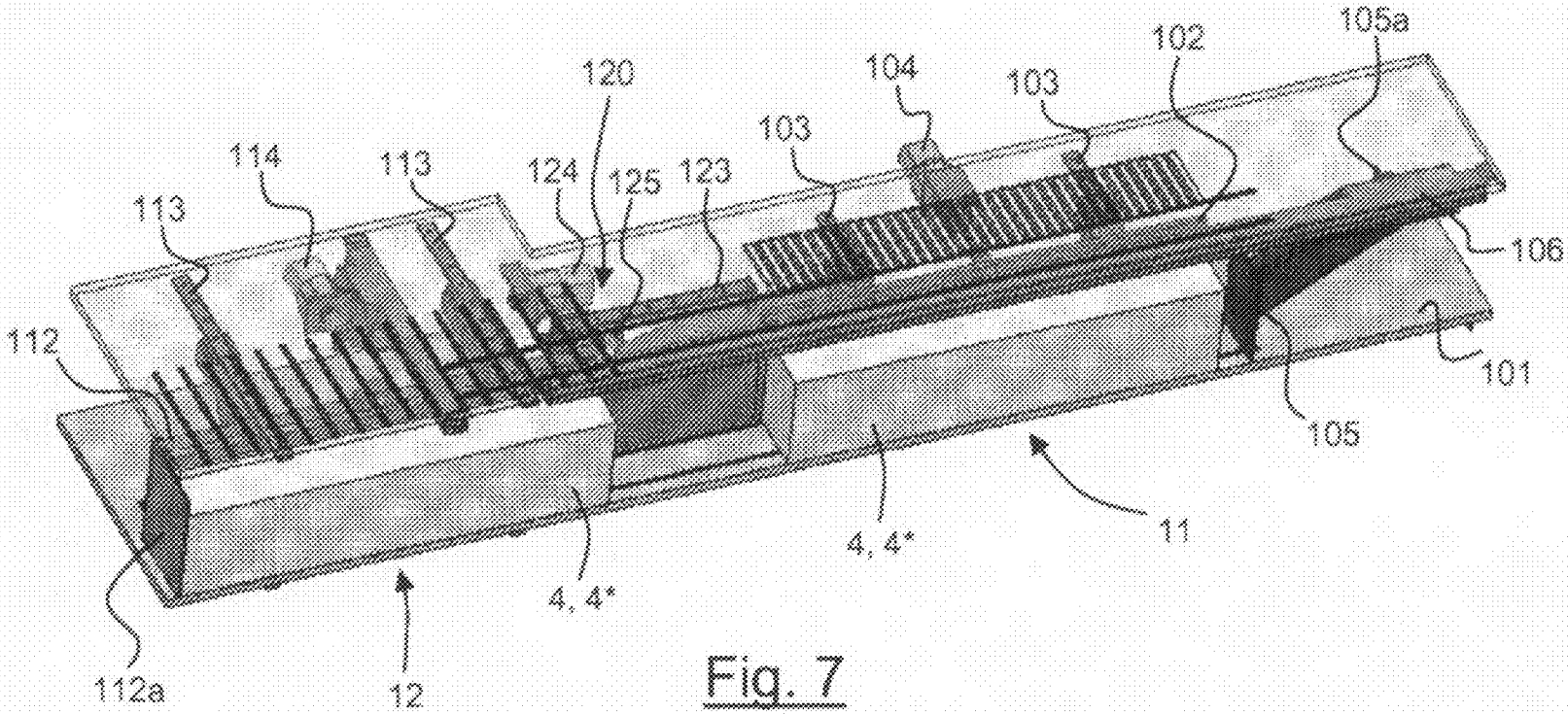
FIG. 7 is a perspective view illustrating in greater detail a storage shelf of a storage device used in the preferred embodiment of the bundle collating system.

FIG. 7 is a perspective view illustrating in greater detail one storage shelf 101 of the storage device 100. As already described, the right-hand side of the storage shelf 101 defines a storage area 11 while the left-hand side of the storage shelf 101 defines a temporary unloading area 12, complete sets 4* of assembled bundle packs 4 being displaced from the storage area 11 to the temporary unloading area 12 under the action of a pusher 105 (which pusher 105 is guided onto a rail 106 and is preferably actuated pneumatically or hydraulically).

Figure 8A:
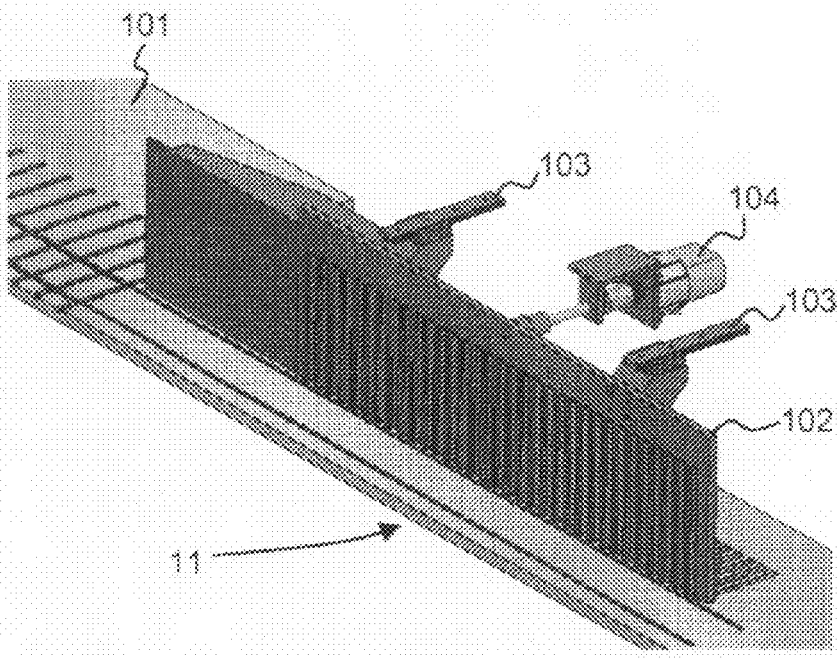
FIGS. 8*a* and 8*b* are two perspective views illustrating a moveable wall mechanism used in a storage area of the storage shelf of FIG. 7.
Figure 8B:
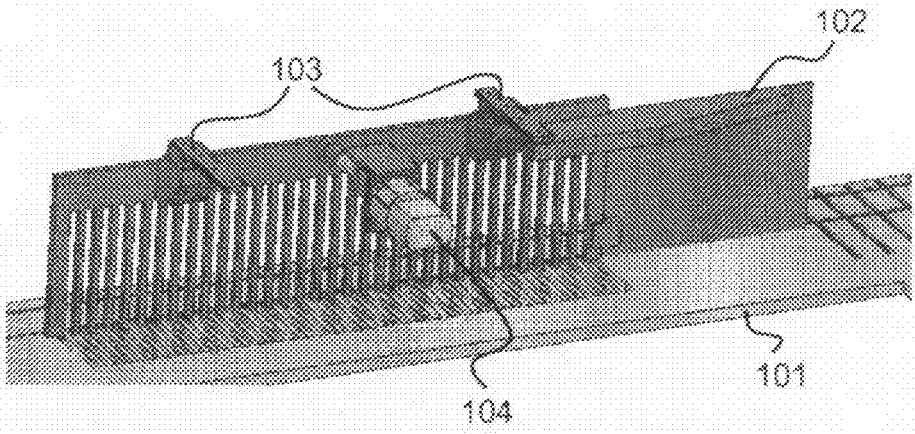

The rear wall 102 at the back of the storage area 11 is designed as a movable wall which can be displaced along guiding rails 103 under the action of an actuator 104, such as a motor. This enables adjustment of the depth of the storage area 11 to the format of the processed securities, namely to the length of the securities. FIGS. 8*a* and 8*b* show the rear wall 102 in isolation with the associated guiding rails 103 and actuator 104.

Figure 9A:
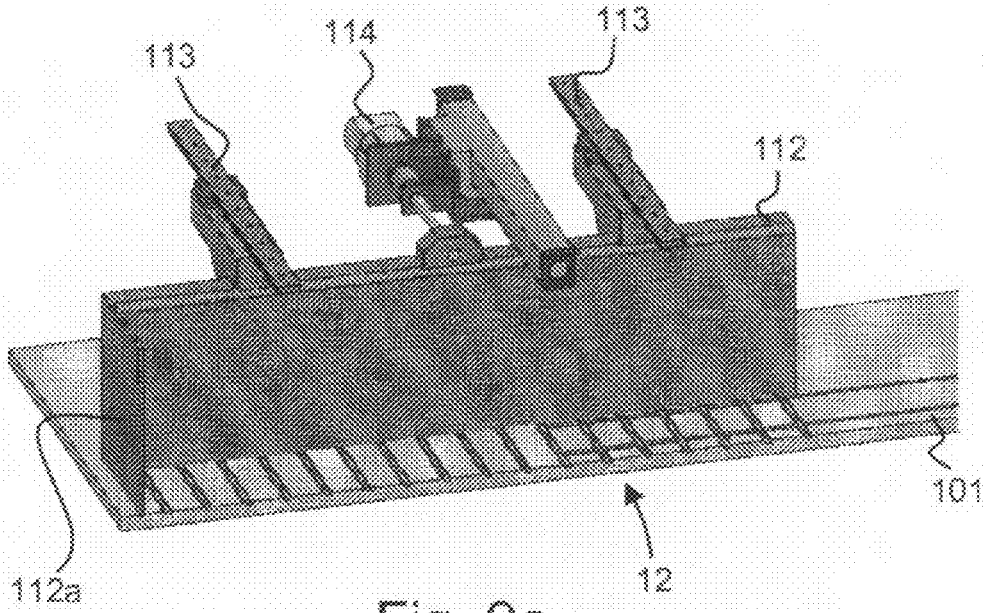
FIGS. 9*a* and 9*b* are two perspective views illustrating a moveable wall mechanism used in a temporary unloading area of the storage shelf of FIG. 7.
Figure 9B:
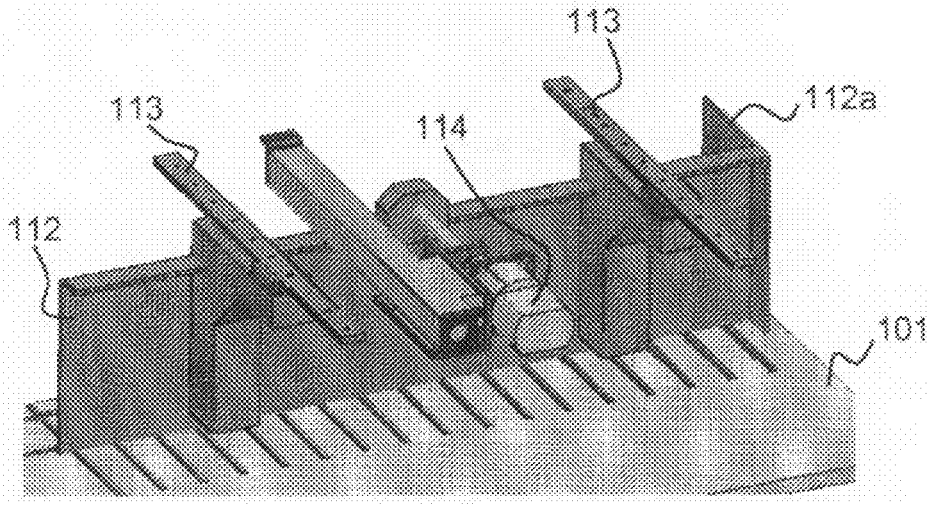

Each temporary unloading area 12 is similarly provided with a movable rear wall 112 that can be displaced along guiding rails 113 under the action of an actuator 114 (such as a motor) in order to adjust the depth of the temporary unloading area 12 to the length of the securities. This other rear wall 112 is provided with an extension 112*a* that sits in the way of the complete set 4* of bundle packs 4 to provide a determined rest position in the temporary unloading area 12 for each set 4* following their displacement under the action of the pusher 105. The movable rear wall 112 however fulfils a further purpose, namely acting as a pusher for emptying the temporary unloading area 12. For this purpose, the guiding rails 113 and actuator 114 are designed in such a way that the rear wall 112 can be moved up to the edge of the storage shelf 101. FIGS. 9*a* and 9*b* illustrate in greater detail the rear wall 112 in isolation with the associated guiding rails 113 and actuator 114.

Figure 10:
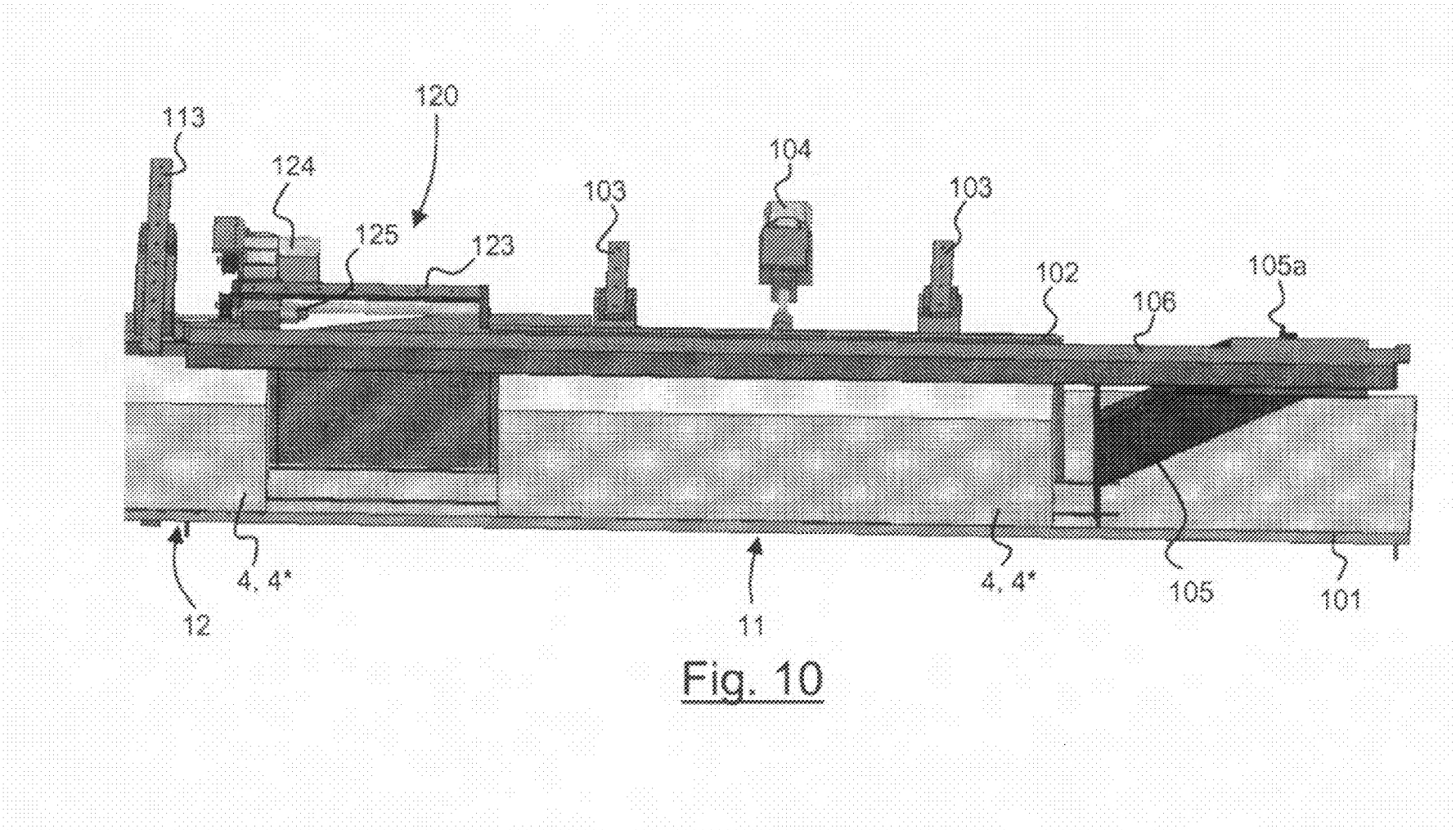
FIG. 10 is a perspective view illustrating a stopping mechanism of the storage shelf of FIG. 7.

As illustrated in FIGS. 7 and 10, a stopping mechanism 120 may advantageously be provided along the path of the pusher 105 so as to stop displacement of the pusher 105 at a selected position, this stopping mechanism 120 being preferably movable along a guiding rail 123 under the action of an actuator 124. This enables adjustment of the position of the stopping mechanism 120 to the width of the complete set 4* of bundle packs 4 (as this width is dependent on the layout and dimensions of the processed sheets). Preferably, the stopping mechanism 120 is further provided with a shock-absorber 125 that cooperates with a protrusion 105*a* on the pusher 105 in order to efficiently stop and decelerate the pusher 105 and the associated set 4* of bundle packs 4 displaced by the pusher 105.

One will now turn to FIGS. 11*a* to 11*d* and 12*a* to 12*d* for a brief description of the bundle spacing station 30. As illustrated in these Figures, the bundle spacing station 30 comprises a spacing mechanism 300 including a plurality of carrier plates 301 (ten in the illustrated example) that are mounted on a common articulated unit 302 guided onto a pair of guiding rails 303 so as to move transversely to the transporting direction of the bundles 3. A first actuator 304 is provided which cooperates with the articulated unit 302 through a spacing device 305 that is coupled to the articulated unit 302 to cause widening or retraction thereof, thereby enabling adjustment of the spacing between the carrier plates 301. A second actuator 306 enables adjustment of a reference position 310 of the whole spacing mechanism 300 along the guiding rails 303. The main purpose of the spacing mechanism 300 is to create clearings between the bundles 3 of each bundle group 3*, thereby facilitating subsequent rotation thereof by the bundle rotating station 40. The spacing mechanism 300 is designed so that the position of the carrier plates 301 can be adjusted to the desired format and layout of the sheets as this will be explained in reference to FIGS. 12*a* to 12*d*.

Figure 11A:
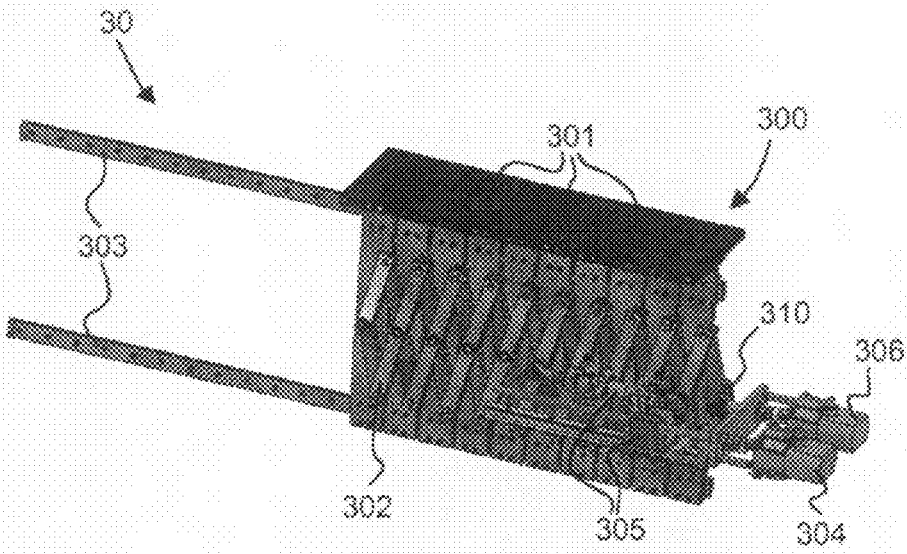
FIGS. 11*a* to 11*d* are perspective views of a same format-adjustable bundle spacing mechanism for creating clearings between bundles shown in four different configurations.
Figure 11B:
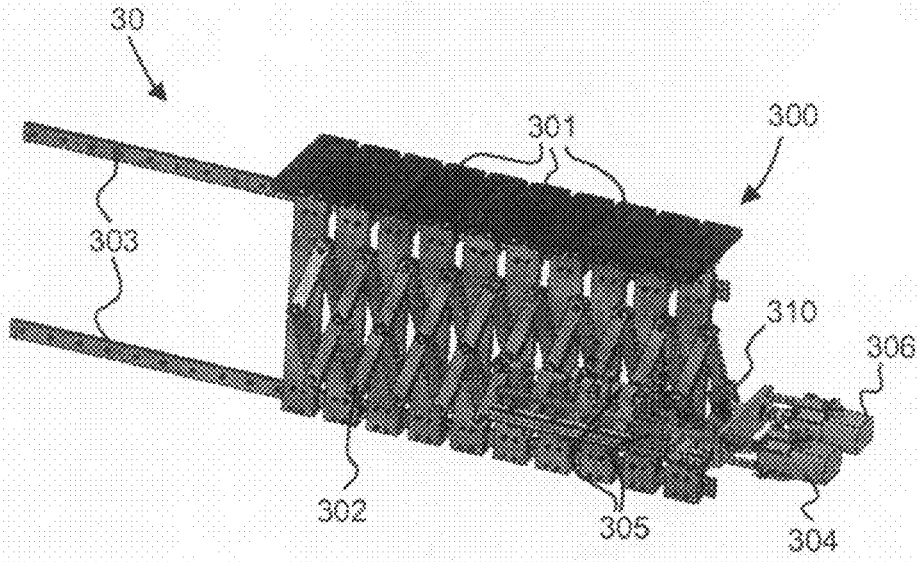
Figures 12A, 12B, 12C, 12D:
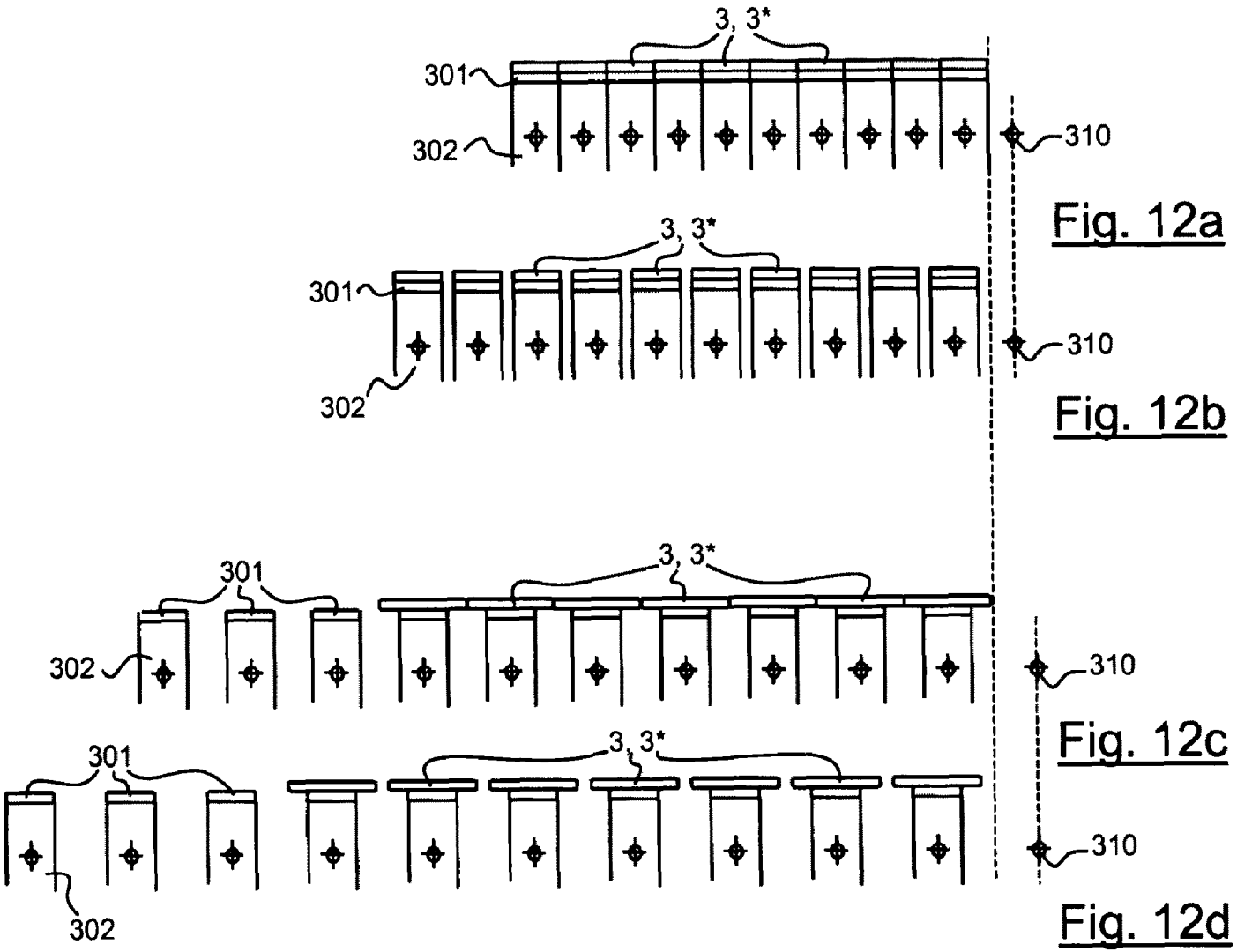
FIGS. 12*a* to 12*d* are schematic side views of the bundle spacing mechanism of FIGS. 11*a* to 11*d;*

FIGS. 12*a* and 12*b* are schematic views corresponding respectively to FIGS. 11*a* and 11*b* and illustrating the configurations of the spacing mechanism 300 for a given sheet format, before and after creation of the clearings between the bundles 3. In the configuration illustrated in FIGS. 11*a* and 12*a*, the spacing mechanism 300 takes the most compact possible configuration where the carrier plates 301 abut against each other. In FIGS. 12*a* and 12*b*, reference 310 denotes the reference position of the spacing mechanism 300. The carrier plates 301 are dimensioned, transversely to the transporting direction of the bundles, such that these carrier plates 301 can cooperate with a corresponding number of bundles 3 of the smallest possible width. In the preferred embodiment, ten such carrier plates 301 are provided as it was determined that the most compact sheet layout would comprise a maximum of ten rows of security prints of the smallest possible width (which width was determined to be of the order of 50 mm in practice). The bundles 3 of each successive bundle group 3* coming out of the second cutting station E (which bundles 3 abut against each other at this stage as shown in FIG. 12*a*) are fed onto the carrier plates 301 of the spacing mechanism 300. The bundles 3 are preferably held against the surface of the carrier plates 301 by suction and the actuator 304 is then activated to widen the articulated unit 302, thereby creating clearings of the order of 10 mm between the bundles as illustrated schematically in FIG. 12*b*.

Figure 11C:
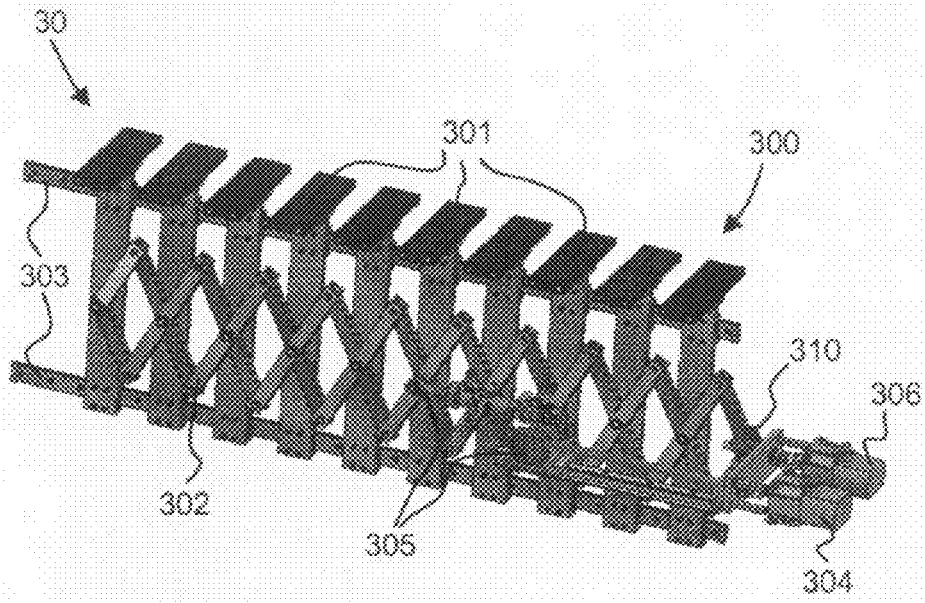
Figure 11D:
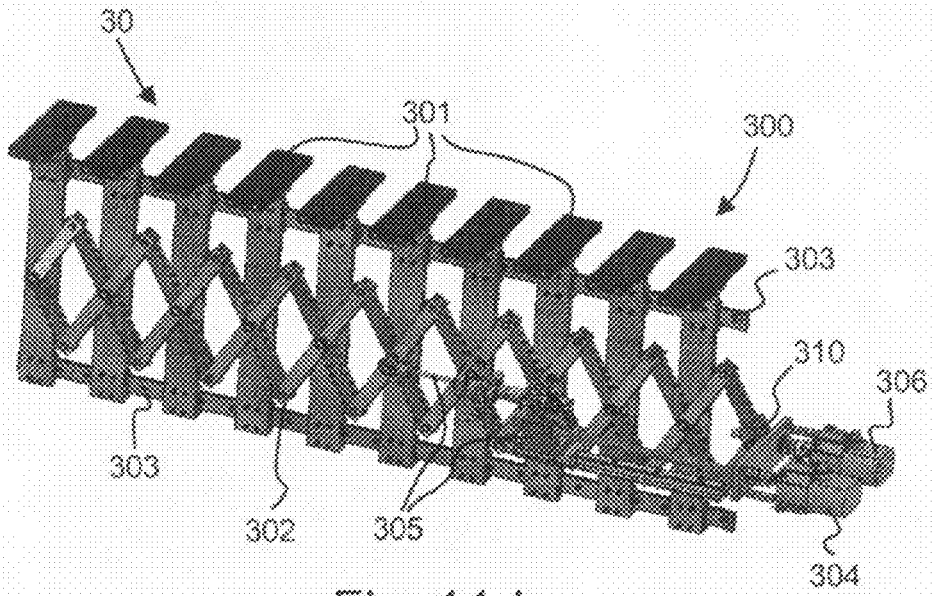

FIGS. 12*c* and 12*d* are schematic views corresponding respectively to FIGS. 11*c* and 11*d* and illustrating the configurations of the spacing mechanism 300 for another given sheet format with securities of the greatest possible width. In the context of the preferred embodiment, it was determined that the sheet layout with security prints of the maximum possible width (which width was determined to be of the order of 90 mm) would comprise a maximum of seven rows of security prints. As illustrated in FIG. 12*c*, the configuration of the spacing mechanism 300 must be adjusted to this new format by acting both on the spacing between the carrier plates 301 (through the first actuator 304) and on the reference position 310 (through the second actuator 306). The bundles 3 of each successive bundle group 3* coming out of the second cutting station E (which bundles 3 abut against each other at this stage as shown in FIG. 12*c*) are fed onto the carrier plates 301 of the spacing mechanism 300, seven bundles 3 being fed in this case to seven out of the ten carrier plates 301. Similarly to the previously described case, the bundles 3 are preferably held against the surface of the carrier plates 301 by suction and the actuator 304 is then activated in order to widen the articulated unit 302 thereby creating clearings between the bundles as illustrated schematically in FIG. 12*d*, such clearings being of the same order of magnitude as in the preceding case.

FIGS. 13*a* to 13*c* are views showing a bundle rotating mechanism 400 for rotating the bundles at the bundle rotating station 40. This bundle rotating mechanism 400 is somewhat similar to the bundle spacing mechanism 300 described hereinabove. Indeed it also comprises a plurality of carrier plates 401 (again ten in the illustrated example) that are mounted on a common articulated unit 402 guided onto a pair of guiding rails 403 so as to move transversely to the transporting direction of the bundles 3. A first actuator 404 is provided which cooperates with the articulated unit 402 through a spacing device 405 to again cause widening or retraction thereof, thereby enabling adjustment of the spacing between the carrier plates 401. A second actuator 406 likewise enables adjustment of a reference position of the whole bundle rotating mechanism 400 along the guiding rails 403. As far as the adjustment of the position of the carrier plates 401 to the sheet layout is concerned, the actuation principle of the bundle rotating mechanism 400 is similar to the previously-described bundle spacing mechanism 300 and will not therefore be described again.

Figure 14A:
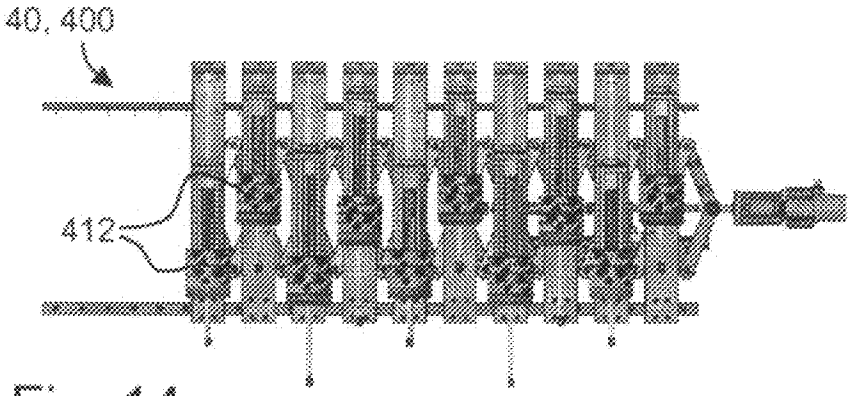
FIGS. 14*a* to 14*c* are schematic side views of the bundle rotating mechanism of FIGS. 13*a* to 13*c;*

In contrast to the bundle spacing mechanism 300, the bundle rotating mechanism 400 is provided with a plurality of additional carrier plates 411 that are coupled to a corresponding plurality of lifting and rotating cylinders 412. These additional carrier plates 411 and lifting and rotating cylinders 412 are mounted on the articulated unit 402 so as to follow the movement of the carrier plates 401. The lifting and rotating cylinders 412 are designed in such a way as to selectively lift any desired one of the additional carrier plates 411 and rotate this latter by 180° as this will be explained hereinafter in reference to FIGS. 14*a* to 14*c*.

Figure 14B:
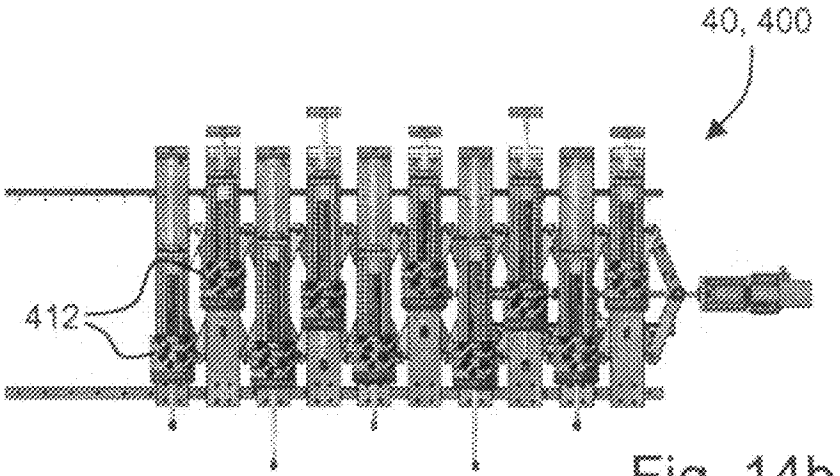
Figure 14C:
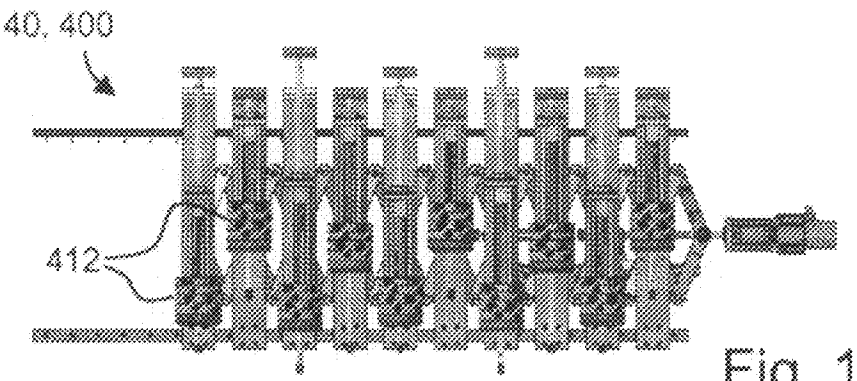

The principle of rotating the bundles by 180° is as such known in the art and aims at somewhat compensating for the negative effects resulting of a varying thickness of the securities (for instance due to the application of OVD foils or patches on the surface of the securities). Indeed, by alternately rotating one bundle out of two within a same pack, one prevents such varying thickness to have a negative effect on the overall assembly of the bundles within a pack and ensures a more or less constant pack height. Within the scope of the present invention, this is achieved by alternately rotating by 180° one out of two bundles 3 within a given bundle group 3*. Prior to rotation of the bundles 3, the bundle rotating mechanism 400 takes the configuration illustrated in FIG. 14*a*. A first bundle group 3 is then fed on top of the carrier plates 411 of the bundle rotating mechanism 400. These bundles 3 are preferably held against the surface of the carrier plates 411 by suction and one out of two cylinders 412 are actuated so as to lift the corresponding carrier plates 411 with the associated bundles and subsequently rotate these by 180°, while the remaining cylinders 412 are not actuated. As illustrated in FIG. 14*b* for instance, the first, third, fifth, seventh and ninth cylinders 412 from the right are actuated. Preferably, as illustrated, the height at which the cylinders 412 lift the carrier plates 411 is alternated from one cylinder to the following so that each bundle 3 can be rotated without interfering with neighbouring bundles. A subsequent bundle group 3* to be disposed in the same storage area as the first bundle group 3*(namely the bundle group corresponding to the same column location in the next stack of sheets to be processed) is processed in a similar way, however by alternating the cylinders 412 that are actuated. As illustrated in FIG. 14*c* for instance, the second, fourth, sixth, eighth and tenth cylinders 412 from the right are actuated in this case. Alternatively, and provided processing time permits, all the bundles 3 of a given bundle group might be rotated by 180° while the bundles 3 of a subsequent bundle group to be disposed in the same storage area is not rotated.

Figure 16:
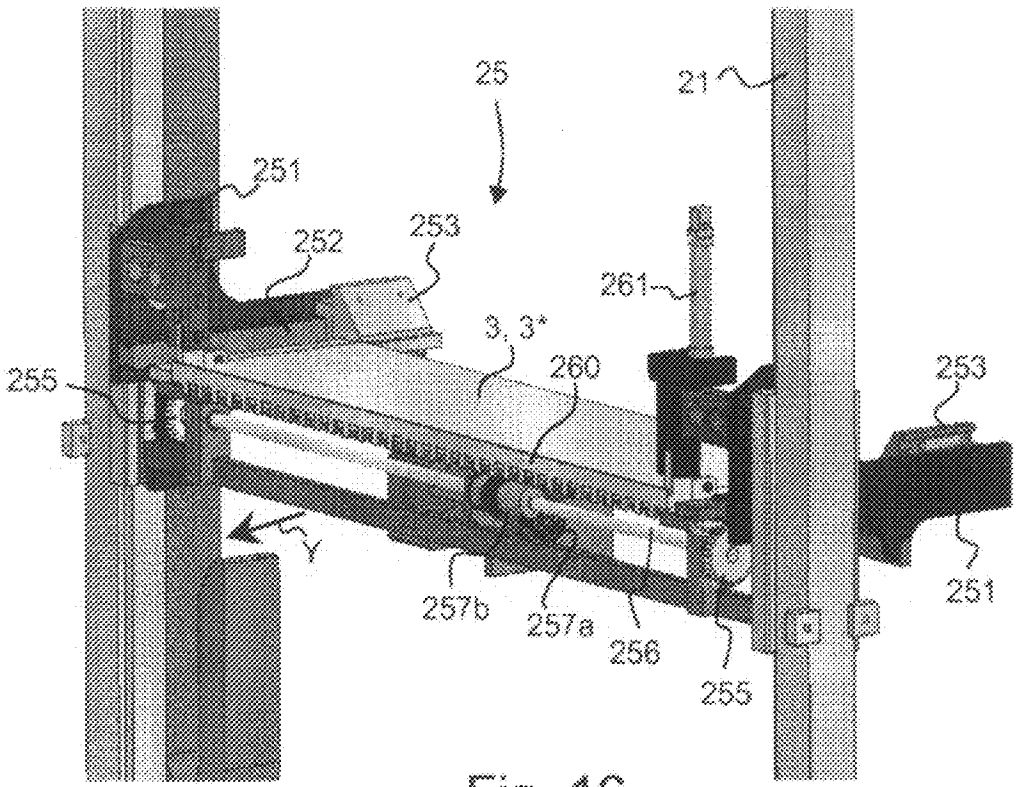
FIG. 16 is an enlarged perspective view of a carrier plate of the loading lift system of FIG. 15.
Figure 15:
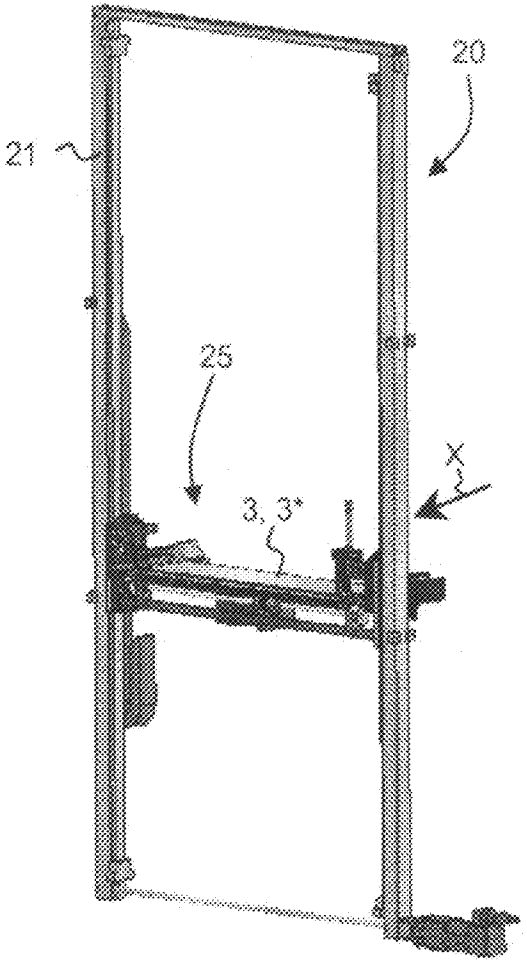
FIG. 15 is an overall perspective view of a loading lift system for loading groups of bundles in storage areas of the bundle collating system.
Figure 17:
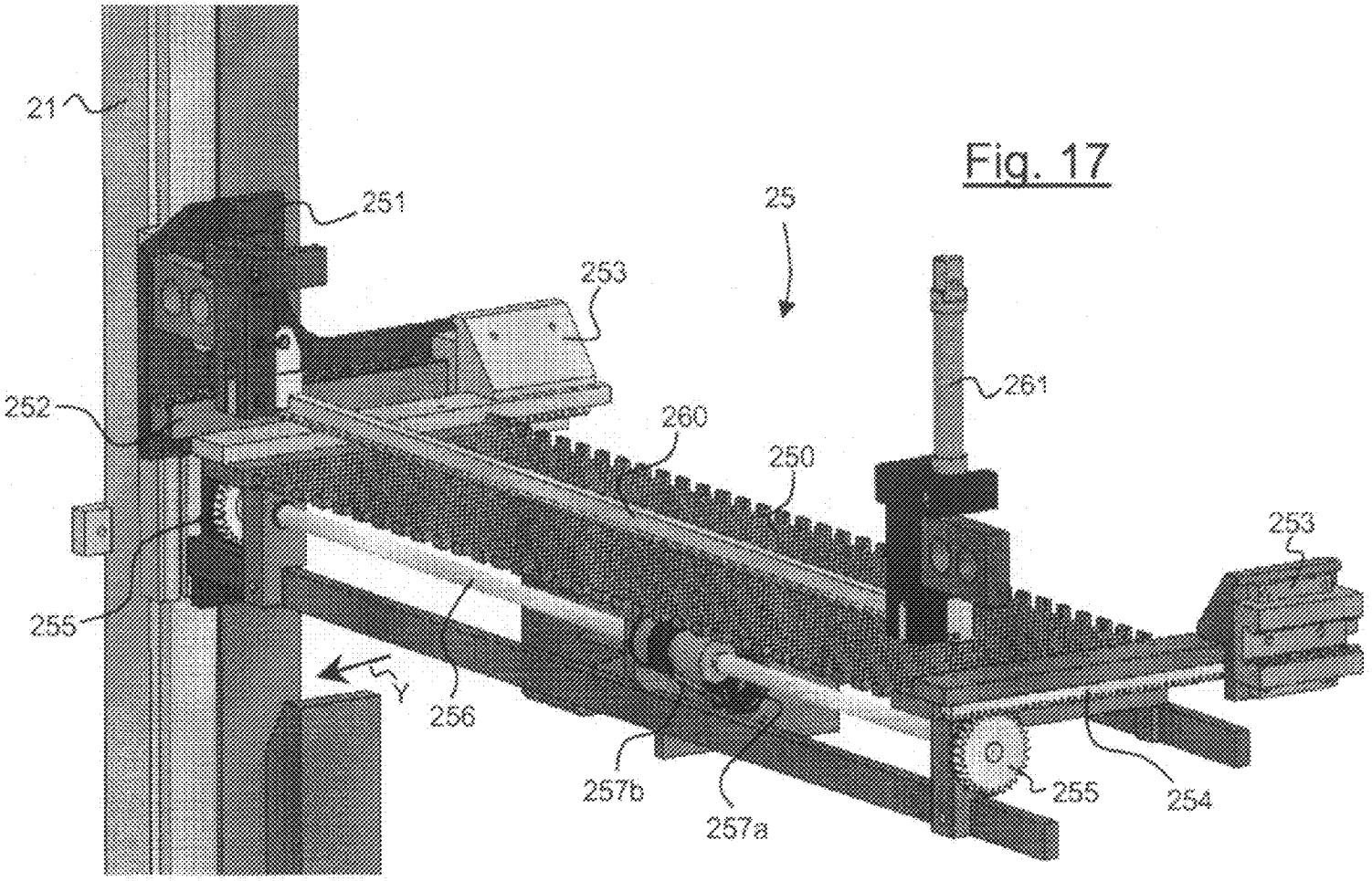
FIG. 17 is an enlarged partial perspective view of the carrier plate of FIG. 16 illustrating means for horizontally-displacing the carrier plate.

One will now turn to FIGS. 15 to 17 for a brief description of the loading lift system 20 for loading bundle groups 3* in the storage areas 11 (not illustrated in FIGS. 15 to 17) of the bundle collating system 10. FIG. 15 is an overall perspective view of a possible embodiment of the loading lift system 20. It mainly comprises a vertical supporting frame 21 (also apparent in FIGS. 4, 5 and 6) onto which is mounted a movable bundle carrier 25 which is designed to receive the bundle groups 3* one by one and carry them to the desired storage area 11 of the storage device 100. In FIGS. 15 to 17, it shall be understood that bundle groups 3* come from the rear of the lift system 20 as schematically indicated by arrow X in FIG. 15 and are delivered in the desired storage area 11 at the front of the lift system 20.

The movable carrier 25 can be displaced vertically along the supporting frame 21 in the manner of a conventional lift system. In addition, part of the carrier 25 is adapted to move horizontally towards the interior of the desired storage area 11 in order to deliver the transported bundle group 3* in the storage area 11 as this will be explained hereinafter. It will be appreciated that FIGS. 15 to 17 show the carrier 25 in its bundle-loading and lifting configuration. In its storage configuration, part of the carrier 25 is moved forward in the direction of arrow Y as indicated in FIGS. 16 and 17.

FIGS. 16 and 17 are an enlarged perspective view of the bundle carrier 25. In FIG. 16 there is shown a bundle group 3* on top of a carrier plate 250 (which carrier plate 250 is visible in FIG. 17), while in FIG. 17 this bundle group 3* has been omitted as well as part of the elements of the bundle carrier 25 in the foreground of the drawing. The carrier 25 is mounted on the supporting frame 21 through a pair of supporting members 251 that are guided vertically thereon. Each supporting member 251 comprises a horizontal guiding rail 252 which cooperates with a corresponding guide member 253 that is secured to the carrier plate 250.

A toothed rack 254 (one being visible in FIG. 17) is provided on each end of the carrier plate 250, on the underside thereof, and cooperates with a corresponding gear wheel 255 at each end of the carrier plate 250. The gear wheels 255 are selectively driven into rotation by a common shaft member 256, the rotation of which is controlled by a motor 257*a* and belt 257*b* arrangement placed under the carrier plate 250. Horizontal displacement of the carrier plate 250 is thus performed under the action of the motor 257*a* and belt 257*b* arrangement which drives into rotation the shaft member 256 and the associated gear wheels 255, which in turn translate the rotation movement into horizontal displacement of the carrier plate 250 through cooperation with the toothed racks 254.

The carrier 25 is further provided with a movable stopper 260 that is secured, at both ends, to the supporting members 251 so that it remains horizontally fixed and does not move horizontally with the carrier plate 250. This movable stopper 260 can take two positions, a lower position (a shown in FIG. 16) where it can cooperates with an edge of the bundle group 3* and a higher position (as shown in FIG. 17) where passage of the bundle group 3* is permitted underneath the stopper 260. To this end the stopper 260 is moved by a corresponding actuator 261. Operation of the stopper 260 is as follows. Before transfer of a new bundle group 3* in a desired one of the storage areas 11, the stopper 260 is brought to its higher position as shown in FIG. 17 so as to enable passage of the bundle group 3* underneath the stopper 260. The bundle group 3* is then brought horizontally forward (along direction Y) inside the desired storage area 11 under the action of the above-described carrier plate displacement mechanism. Once the carrier plate 250 has been brought forward in the corresponding storage area 11, together with the bundle group 3*, the stopper 260 is brought downwards to its lower position and the carrier plate 250 is displaced backwards back to its bundle-loading and lifting configuration. In the process, the trailing edge of the bundle group 3* which is still carried by the carrier plate 250 comes in contact with the stopper 260 and further displacement of the bundle group 3* is prevented, thereby unloading the bundle group 3* from the carrier plate 250 in the storage area 11. It will of course be understood that the lift system 20 is designed to lift the bundle group 3* to the appropriate height so that it is either unloaded on the surface of an empty storage shelf 101 or on top of a previously-stored bundle group 3*.

Figure 18:
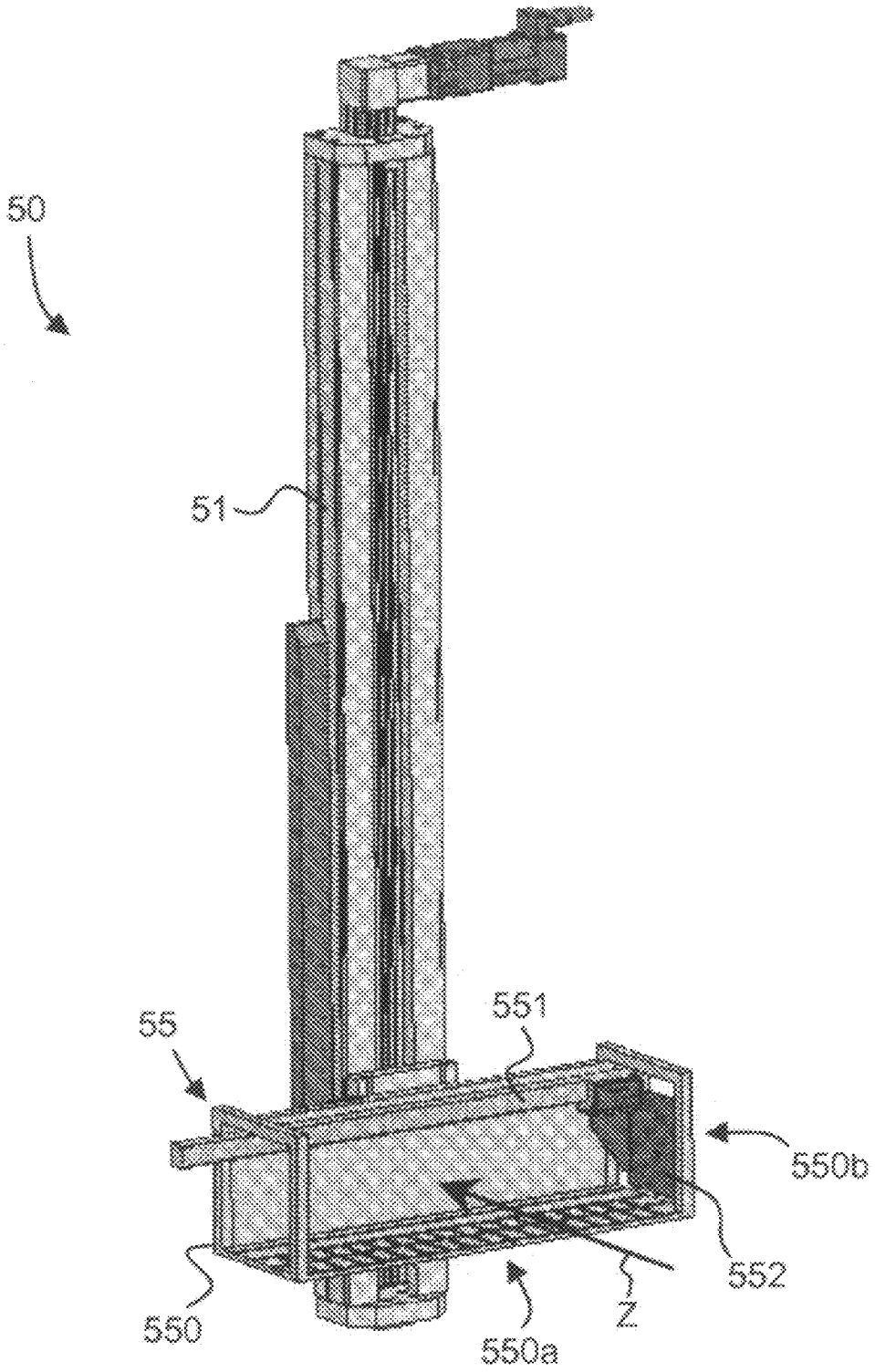
FIG. 18 is an overall perspective view of an unloading lift system for unloading complete sets of assembled packs of bundles from the bundle collating system.

Let us now turn to FIG. 18 for a brief description of the unloading lift system 50 for unloading the complete sets 4* of assembled bundle packs from the bundle collating system 10 to the output station 60 illustrated in FIGS. 1, 2, 4 and 6. FIG. 18 is an overall perspective view of a possible embodiment of the unloading lift system 50, which embodiment is slightly different from the one schematically illustrated in FIGS. 1 to 6.

The unloading lift system 50 of FIG. 18 comprises a supporting mast 51 onto which the carrier 55 is vertically guided. In FIG. 18, the supporting mast 51 is disposed on the rear end part of the carrier 55, with respect to the unloading direction of the complete sets 4*(not illustrated) of assembled packs from the storage device 100, which unloading direction is schematically illustrated by arrow Z. In FIGS. 4 and 6, this supporting mast 51 is shown on a side of the carrier 55, which as such is not critical for the function of the unloading lift system 50. The carrier 55 basically comprises a supporting frame 550 for reception of the complete sets 4* of bundle packs that have to be unloaded, with a lateral opening 550*a* dimensioned to permit passage of these sets 4* in the unloading direction Z. This frame 550 further comprises another lateral opening 550*b*, oriented perpendicularly to the unloading direction Z, and enabling lateral unloading of the carrier 55 when in front of the output station 60. The carrier 55 further comprises a pusher mechanism for unloading the complete set 4* of bundle packs 4 from the carrier through the unloading opening 550*b*. This pusher mechanism comprises a pusher 552 that can be displaced along a rail 551 under the action of driving means which are not illustrated but are preferably pneumatic or hydraulic driving means. FIG. 18 shows the pusher 552 in its unloading position, i.e. after a complete set 4* of bundle packs 4 has been discharged from the carrier 55 to the output station 60.

Unloading of a complete set 4* of assembled bundle packs 4 from the storage device 100 to the carrier 55 of the unloading lift system 50 is performed by first lifting the carrier 55 in front of the desired temporary unloading area 12 of the storage device 100 and actuating the corresponding movable wall 112 (as described hereinabove) so that the complete set 4* of assembled bundle packs 4 is pushed out of the unloading area 12 onto the carrier 55. The carrier 55 is then brought in front of the output station 60 where the pusher 552 is activated so as to unload the complete set 4* of assembled bundle packs 4 to the output station 60.

As already mentioned, in the output station 60, the assembled bundle packs are isolated one by one by an appropriate mechanism 61 (schematically illustrated in FIG. 4) and then fed to the subsequent final processing station G, e.g. the banding device G.1 schematically illustrated in FIGS. 1, 2, 4 and 6.

It will be understood that various modifications and/or improvements obvious to the person skilled in the art can be made to the embodiments described hereinabove without departing from the scope of the invention defined by the annexed claims.

In particular, while it was mentioned that, within the scope of the preferred embodiment of the invention, the maximum number of columns of security prints per sheet would be six and the maximum number of rows of security prints per sheet would be ten, these limits shall be considered as being purely illustrative of the current practice. The same is true regarding the sheet dimensions.

Similarly, while the preferred embodiment shows fixed storage areas, other embodiments of the invention might provide for movable storage areas. For instance, the storage device might be designed as a paternoster system with endless conveying means for positioning any desired one of the storage areas in front of the processed bundle groups for loading thereof. With such an embodiment, a loading lift system would not be necessary any more, this being however made at the costs of an increase in complexity of the storage device.

The invention claimed is:

1. A method for processing stacks of sheets of securities into bundles and bundle packs, said sheets each having an array of security prints printed thereon which array comprises M columns and N rows, said method comprising the following steps:

a) cutting a first stack of sheets along said rows into N successive bundle strips each comprising M bundle positions;

b) regrouping said N successive bundle strips into a regrouped formation corresponding to the Original formation of the first stack of sheets;

c) cutting said regrouped N bundle strips along said columns into M successive bundle groups of N individual bundles each;

d) storing said M successive bundle groups in M separate storage areas, which storage areas are vertically superposed, whereby each one of said M successive bundle groups is stored in a predetermined one of said M separate storage areas in a single operation, with all of the N individual bundles of each one of said M successive bundle groups also being transferred simultaneously in the predetermined one of said M separate storage areas;

e) processing a subsequent stack of sheets according to steps a) to d) whereby each one of the M successive bundle groups processed from said subsequent stack of sheets is piled in the same predetermined one of said M separate storage areas as the first stack of sheets;

f) repeating step e) until K stacks of sheets have been processed, whereupon each storage area contains a complete set of N bundle packs of K bundles each;

g) emptying said M separate storage areas and processing each complete set into N distinct bundle packs of K bundles; and h) repeating steps a) to g) with subsequent stacks of sheets.

2. The method according to claim 1, wherein prior to regrouping the N successive bundle strips into the regrouped formation, each bundle strip is banded with M surrounding bands around said M bundle positions.

3. The method according to claim 1 or 2, wherein, prior to storing the M successive bundle groups in the storage areas, bundles are rotated by 180 degrees, rotation of the bundles being alternated in such a manner that each bundle pack consists of an alternate succession of rotated and non-rotated bundles.

4. The method according to claim 3, wherein, rotation of the bundles is performed by alternately rotating by 180 degrees one bundle out of two within a bundle group.

5. The method according to claim 4, wherein rotation of a bundle includes lifting the bundle by an amount such that it can be rotated without interfering with neighbouring bundles.

6. The method according to claim 3, wherein, prior to rotating said bundles, the bundles of each bundle group are drawn apart.

7. The method according to claim 1, wherein said bundles are stored and piled in said storage areas and are emptied from said storage areas in unloading areas prior to processing into said individual bundle packs.

8. The method according to claim 7, wherein said unloading areas are placed next to said storage areas, emptying of said storage areas being performed by laterally pushing the complete sets of bundle packs from the storage areas into the unloading areas.

9. The method according to claim 1, wherein storage of said M successive bundle groups is performed in M separate storage areas selected among a predetermined number of available storage areas.

10. The method according to claim 9, wherein said predetermined number of available storage areas is at least six.

11. The method according to claim 1, wherein each storage area has a storage capacity sufficient for storing at least up to ten bundle packs aligned one next to the other.

12. A bundle collating system for collecting bundles which have been processed from stacks of sheets each having an array of security prints printed thereon which array comprises M columns and N rows, wherein M successive bundle groups of N individual bundles each are produced as a result of row-wise and column-wise cutting of each stack of sheets, said bundle collating system comprising:

a storage device With a plurality of superposed storage shelves each defining a storage area having a storage capacity sufficient for storing and piling said M successive bundle groups of N individual bundles into N bundle packs of K bundles, the number of said storage shelves being selected to correspond to a maximum number of columns ($M_{MAX}$) of security prints on said sheets; and conveying means for transferring said M successive bundle groups of N individual bundles to the storage shelves, said conveying means comprising a loading lift system for lifting any one of said M successive bundle groups in a single operation to any one of said storage shelves and transferring all of the N individual bundles of each one of said M successive bundle groups simultaneously in the storage area.

13. The bundle collating system according to claim 12, wherein said storage device comprises at least six superposed storage shelves.

14. The bundle collating system according to claim 12, wherein each storage area has a storage capacity sufficient for storing at least up to ten bundle packs aligned one next to the other.

15. The bundle collating system according to claim 12, wherein a storage capacity of said storage areas is adjustable to the format of the bundles.

16. The bundle collating system according to claim 12, further comprising a bundle rotating station for rotating bundles by 180 degrees, said bundle rotating station comprising a rotation mechanism with a plurality of carrier plates actuated by lift and rotation cylinders for selectively lifting and rotating any desired bundle among the bundles of each said bundle groups.

17. The bundle collating system according to claim 16, wherein a position of said plurality of carrier plates and lift and rotation cylinders, transversely to the direction of displacement of said bundle groups, is adjustable.

18. The bundle collating system according to claim 17, wherein said plurality of carrier plates and lift and rotation cylinders are coupled to a common articulated unit for transverse positional adjustment.

19. The bundle collating system according to claim 16, wherein said lift and rotation cylinders are adapted to lift the bundles to different heights which are selected in such a manner that interferences between two neighbouring bundles during rotation thereof are avoided.

20. The bundle collating system according to claim 16, wherein said rotating mechanism comprises at least ten carrier plates and lift and rotation cylinders.

21. The bundle collating system according to claim 16, further comprising a bundle spacing station for creating clearings between bundles, said bundle spacing station comprising a spacing mechanism with a plurality of carrier plates for cooperation with the bundles of each said bundle groups.

22. The bundle collating system according to claim 21, wherein a position of said plurality of carrier plates, transversely to the direction of displacement of said bundle groups, is adjustable.

23. The bundle collating system according to claim 22, wherein said plurality of carrier plates are coupled to a common articulated unit for transverse positional adjustment.

24. The bundle collating system according to claim 21, wherein said spacing mechanism comprises at least ten carrier plates.

25. The bundle collating system according to claim 12, wherein said storage shelves are further provided with unloading areas placed next to the storage areas and a pusher for emptying the complete sets of bundle packs from said storage areas into said unloading areas.

26. The bundle collating system according to claim 25, further comprising a stopping mechanism for stopping displacement of said pusher at a selected end position.

27. The bundle collating system according to claim 26, wherein said Selected end position is adjustable.

28. The bundle collating system according to claim 26, wherein said stopping mechanism comprises a shock-absorber for cooperating with said pusher.

29. The bundle collating system according to claim 24, further comprising an unloading lift system for emptying said unloading areas.

30. A sheet processing system comprising a bundle collating system according to claim 12.

31. The method according to claim 1, wherein said securities are banknotes.

* * * * *

UNITED STATES PATENT AND TRADEMARK OFFICE

CERTIFICATE OF CORRECTION

PATENT NO. : 8,006,970 B2
APPLICATION NO. : 12/309120
DATED : August 30, 2011
INVENTOR(S) : Hartmut Karl Saver It is certified that error appears in the above-identified patent and that said Letters Patent is hereby corrected as shown below:

- column 3, line 30, “Advantages” should be replaced by -- Advantageous --
- column 13, line 33, “Original” should be replaced by -- original --

Signed and Sealed this
Eighteenth Day of October, 2011

David J. Kappos

David J. Kappos
*Director of the United States Patent and Trademark Office*